US006900797B2

(12) United States Patent
Hirakawa et al.

(10) Patent No.: US 6,900,797 B2
(45) Date of Patent: May 31, 2005

(54) METHOD FOR DRIVING PDP AND DISPLAY APPARATUS

(75) Inventors: Hitoshi Hirakawa, Kawasaki (JP); Takashi Shiizaki, Kawasaki (JP); Tatsuhiko Kawasaki, Kawasaki (JP); Satoru Nishimura, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 475 days.

(21) Appl. No.: 09/771,583

(22) Filed: Jan. 30, 2001

(65) Prior Publication Data

US 2002/0039086 A1 Apr. 4, 2002

(30) Foreign Application Priority Data

Oct. 4, 2000 (JP) ..... 2000-304404

(51) Int. Cl.[7] ..... G09G 5/00
(52) U.S. Cl. ..... 345/208; 345/60; 313/631
(58) Field of Search ..... 345/60–63, 68, 345/204, 208–213; 313/491, 582, 631

(56) References Cited

U.S. PATENT DOCUMENTS 5,854,540 A * 12/1998 Matsumoto et al. ..... 315/169.1
6,091,380 A * 7/2000 Hashimoto et al. ..... 345/60
6,144,349 A 11/2000 Awata et al.
6,320,326 B1 11/2001 Shino et al.
6,342,873 B1 1/2002 Ueoka et al.
6,344,841 B1 * 2/2002 Moon ..... 345/60
6,380,912 B1 4/2002 Kang et al.
6,420,830 B1 * 7/2002 Youn ..... 313/586
6,452,590 B1 * 9/2002 Awamoto et al. ..... 345/211
6,489,722 B1 * 12/2002 Yoshida et al. ..... 313/582
6,504,519 B1 1/2003 Ryu et al.
2001/0024092 A1 9/2001 Kim et al.
2002/0039086 A1 4/2002 Hirakawa et al.

FOREIGN PATENT DOCUMENTS

JP 10-003280 1/1998
JP 2000-39866 2/2000

* cited by examiner

*Primary Examiner*—Kent Chang
(74) *Attorney, Agent, or Firm*—Staas & Halsey LLP

(57) ABSTRACT

A progressive display is realized that has an electrode structure in which two neighboring rows share a display electrode. A PDP has display electrodes arranged so that two neighboring rows share one electrode for display, and the display electrodes crosses an address electrode in each column. A row selection is performed by temporarily biasing one display electrode $Y_j$ of the electrode pair corresponding to the selected row to the selecting potential Vy, while an addressing is performed by controlling the potential of the address electrode $A_k$ in accordance with the display data. At that time, the cell-selecting voltage Vay that is applied to the interelectrode AY between the display electrode $Y_j$ and the address electrode $A_k$ made lower than the discharge starting voltage $V_{AY}$ of the interelectrode AY. A row selection voltage Vxy that is lower than the discharge starting voltage $V_{XY}$ is applied to the interelectrode XY between the display electrodes of the electrode pair corresponding to the selected row, so that an address discharge is generated.

11 Claims, 20 Drawing Sheets

METHOD FOR DRIVING PDP AND DISPLAY APPARATUS

BACKGROUND OF THE INVENTION

1. Field of the Invention

The present invention relates to a method for driving a plasma display panel (PDP) of a surface discharge format and a display apparatus.

A PDP is commercialized as a wall-hung TV set or a monitor display of a computer, and the screen size thereof has reached 60 inches. In addition, PDP is a digital display device made of binary light emission cells, so it is suitable for a display of digital data and is expected as a multimedia monitor. In order to respond the market request and to promote a large size and a high definition, it is necessary to develop a panel structure as well as a driving method.

2. Description of the Prior Art

An AC type PDP for a color display employs a surface discharge format. The surface discharge format has an arrangement of electrodes in which display electrodes that become anodes and cathodes in a display discharge for ensuring a luminance are arranged in parallel on a front or back substrate, and address electrodes are arranged so as to cross a pair of the display electrodes. In the surface discharge format PDP, a partition is necessary for separating a discharge space for each column of a matrix display along the longitudinal direction of the display electrode (hereinafter referred to as the row direction). As the simplest partition pattern having good productivity, a so-called stripe pattern is known in which a linear band-like partition in a plan view is arranged at each boundary between columns.

There are two kinds of arrangements of display electrodes in the surface discharge format. In one arrangement, a pair of display electrodes is arranged for each row. The total number of the display electrodes is twice the number of rows n. In this format each row is independent of other rows, so the driving sequence can be simplified. However, in the case of the stripe pattern, an electrode gap between neighboring rows (referred to as a reverse slit) should be sufficiently large value, e.g., several times an arrangement interval (a surface discharge gap length) so as to prevent an interference of discharge between rows. In the other arrangement, display electrodes whose number is the number of rows n plus one are arranged substantially at the constant pitch. In this format, neighboring display electrodes constitute an electrode pair for a surface discharge, and each display electrode except for the both ends of the arrangement works for both displays of an odd row and an even row. From the viewpoint of a high definition (a fine pitch of rows) and effective usage of a display surface, the arrangement at a constant pitch is advantageous.

In a display, regardless of the arrangement format of display electrodes, an address discharge is generated between one electrode of the display electrode pair corresponding to each row and the address electrode, and a discharge is generated between display electrodes using the address discharge as a trigger, so that a charge quantity in a dielectric (a wall charge quantity) is controlled for addressing in accordance with a display content. After the addressing, a sustaining voltage Vs having alternating polarity is applied to the display electrode pair. The sustaining voltage Vs satisfies the inequality (1).

$$Vf_{XY}-V_{WXY}<Vs<Vf_{XY} \quad (1)$$

Here, $Vf_{XY}$ is a discharge starting voltage between display electrodes, and $V_{WXY}$ is a wall voltage between display electrodes.

By applying the sustaining voltage Vs, a cell voltage (a sum of a driving voltage applied to an electrode and a wall voltage) exceeds the discharge starting voltage $Vf_{XY}$ only in the cell having a predetermined quantity of wall charge, so that a surface discharge is generated along a substrate surface. If the application period is shortened, the light emission looks continuous.

FIG. 20 shows waveforms of cell voltage during the address period in the conventional driving method. In the address period TA, one electrode of the display electrode pair (i.e., a display electrode Y) is used as a scanning electrode for row selection in a screen having n rows and m columns. Display electrodes except for the scanning electrodes are display electrodes X. At the starting point of the address period TA, all display electrodes Y are biased to the non-selecting potential Vya', and all display electrodes X are biased to a predetermined potential Vxa' for preventing misdischarge. After that, the display electrode $Y_j$ corresponding to the selected row j ($1 \leqq j \leqq n$) is temporarily biased to the selecting potential Vy' (application of a scanning pulse).

In synchronization with the row selection, the address electrode A of the row to which the selected cell belongs that generates the address discharge among the selected row is biased to the selecting potential Va' (application of an address pulse). In FIG. 20, the row k is shown as a typical row, and the address electrode $A_k$ is biased to the selecting potential Va' in the selected period of each row (j−1), j or (j+1). The bias potential Vxa' of the display electrode $X_j$ is set so that the cell voltage of the interelectrode XY is a little lower than the discharge starting voltage $Vf_{XY}$ when the scanning pulse is applied to the display electrode $Y_j$. Thus, when an address discharge is generated at the interelectrode AY between the address electrode Ak and the display electrode $Y_j$, the address discharge causes a discharge (hereinafter referred to as an address discharge for convenience's sake) at the interelectrode XY. The address discharge is not generated at the interelectrode XY of the non-selected cell having not trigger. Typical voltage setting is as follows.

The bias potential Vxa' of the display electrode X is 80–90 volts.

The selecting potential Vy' (the amplitude of the scanning pulse) is −170 volts.

The selecting potential Va' (the amplitude of the address pulse) is 60–70 volts.

In the conventional driving method, the cell-selecting voltage Vay' applied to the interelectrode AY by the scanning pulse and the address pulse is set to the value (230–240 volts) higher than the discharge starting voltage $Vf_{AY}$ of the interelectrode AY regardless of the potential of the display electrode X, so that an address discharge is generated at the interelectrode AY. Namely, the addressing is performed in which a cell is selected by controlling potentials of two kind electrodes (the display electrode Y and the address electrode A) out of three kinds electrodes.

As explained above, in a PDP having a structure of display electrodes that are arranged at a constant pitch, one display electrode is commonly used by both displays of an odd row and an even row, so the display format is limited to an interlaced format. In the interlaced format, a half of the total rows are not used for display of each field. For example, even rows do not emit light in odd fields. Therefore, luminance of the display becomes lower than the progressive format. Especially, if the partition pattern is a grid pattern that can prevent the interference of discharge securely, the light emission area of each cell becomes narrower than in the case of the stripe pattern, so the non-light emission area in the screen increases. If the display is performed in which display data of one row are adapted to two rows in each field for increasing the luminance, the resolution in the column direction is reduced by half. Furthermore, the interlaced format can hardly satisfy a display quality that is required to high-resolution equipment such as a DVD or a full-specification HDTV, since a flicker is generated in a still picture display.

SUMMARY OF THE INVENTION

An object of the present invention is to provide a progressive display having an electrode structure in which two neighboring rows share a display electrode.

In the present invention, as a first aspect, three electrodes related to each cell, i.e., a pair of display electrodes for row display and an address electrode for selecting a column are controlled so that an address discharge is generated only when a predetermined voltage is applied to each of three interelectrodes among the three electrodes. In addressing process, the voltage applied to each of the three interelectrodes is controlled not to exceed the discharge starting voltage, and the application period of the voltage is set individually for three interelectrodes. The potential of each electrode is controlled so that the address discharge is not generated when the application periods of only two interelectrodes overlap but is generated when the application periods of three interelectrodes overlap with each other. For example, a voltage a little lower than the discharge starting voltage is applied to the interelectrode AY between one electrode of the display electrode pair and the address electrode, so that the selected cell becomes the state just before the discharge. In this state, an appropriate voltage lower than the discharge starting voltage is applied to the interelectrode XY between the display electrodes. When the electric field of the interelectrode XY is added to the electric field of the interelectrode AY, discharges are generated at the interelectrode XY and at the interelectrode AY substantially simultaneously. By this control, the rows can be selected independently also in the electrode structure in which two neighboring rows share a display electrode, so that the progressive display can be realized.

Concerning the potential control according to the present invention, a driving circuit that can control all display electrodes independently can be used. Otherwise, a driving circuit that can control one electrode of the display electrode pair can be used. In the latter case, the address period is divided into a first half and a second half, and the other electrode of the display electrode pair (the non-individually controlled electrode) is divided into two groups. Then, one group of display electrodes is made active in the first half, and the other group of display electrodes is made active in the second half.

There are two kinds of electrode structures in which two neighboring rows share a display electrode. In one structure the display electrodes are arranged at a constant pitch, while in the other structure a pair of display electrodes is arranged for each row so that one display electrode is connected with that of the neighboring row. In addition, in the structure of connecting non-neighboring rows by a multilayered wiring, the progressive display can be realized in accordance with the control of the present invention.

In the present invention, as a second aspect, the address period is divided into a first half and a second half so as to realize an erasing format of addressing. In the first half the polarity of the wall charge of the row that is selected in the second half is inverted, while in the second half the polarity of the wall charge of the row that is selected in the first half is inverted, so that an independent row selection is realized for each of two rows sharing a display electrode.

DESCRIPTION OF THE PREFERRED EMBODIMENTS

Hereinafter, the present invention will be explained more in detail with reference to embodiments and drawings.

Figure 1:
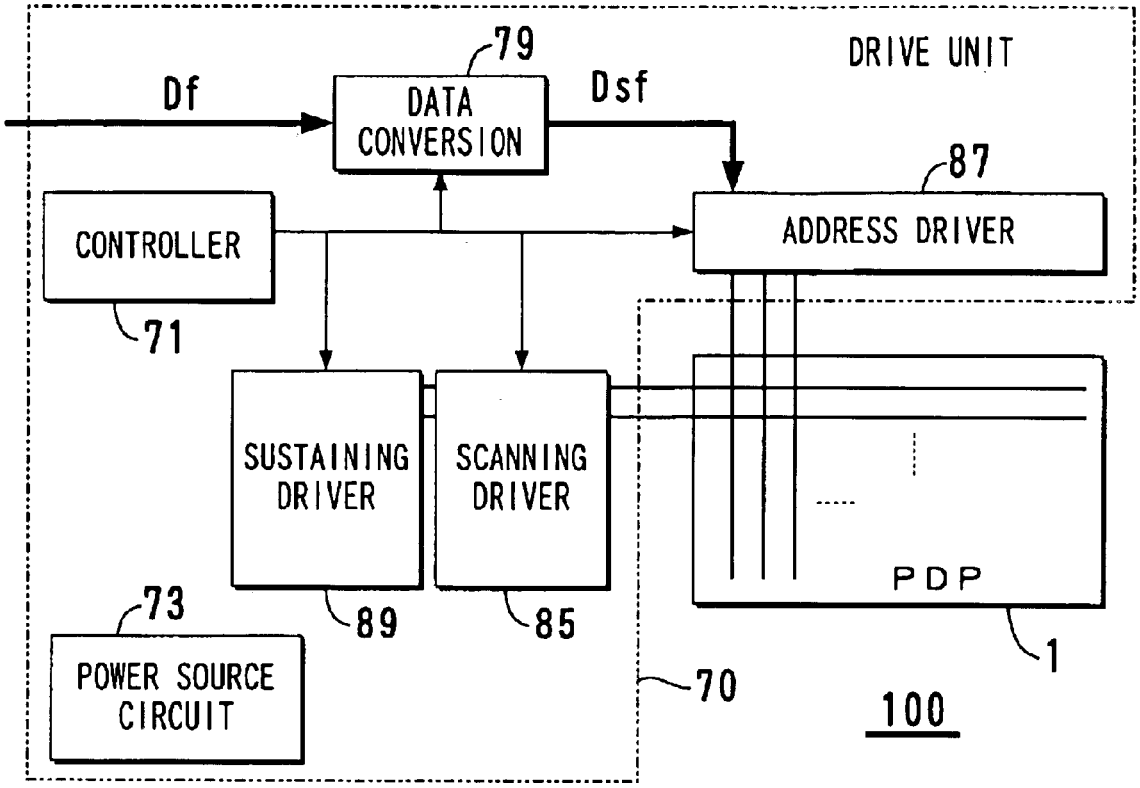
FIG. 1 is a block diagram of a display apparatus according to the present invention.

FIG. 1 is a block diagram of a display apparatus according to the present invention. A display apparatus 100 comprises a surface discharge type PDP 1 having a display surface including m×n cells, a driving unit 70 for selectively activating cells arranged in a matrix to emit light. The display apparatus 100 is used as a wall-hung TV set or a monitor display of a computer system.

In the PDP 1, display electrodes constituting an electrode pair for generating a display discharge are placed in parallel, and address electrodes are arranged so as to cross the display electrodes. The display electrode extends in the row direction of the screen (in the horizontal direction), and the address electrode extends in the column direction (in the vertical direction).

The driving unit 70 includes a controller 71, a power source circuit 73, a data converting circuit 79, a scanning driver 85, an address driver 87, and a sustaining driver 89. The driving unit 70 is supplied with frame data Df that are multivalued image data indicating luminance levels of red, green and blue colors from an external device such as a TV tuner or a computer along with various synchronizing signals. The frame data Df are temporarily memorized in a frame memory included in the data converting circuit 79.

In the display performed by the PDP 1, a binary control for lighting reproduces gradation, so a time series frame of an input image is divided into subframes of a predetermined number q. The data converting circuit 79 converts the frame data Df into subframe data Dsf for the gradation display and sends the data to the address driver 87. The subframe data Dsf are a group of display data for q screens, in which one bit corresponds to one cell. A value of each bit indicates whether the cell in the corresponding subframe requires a light emission, more exactly whether the address discharge is required or not.

The scanning driver 85 applies a scanning pulse for row selection to n of display electrode pairs. The address driver 87 controls potentials of m address electrodes in accordance with the subframe data Dsf. The sustaining driver 89 applies a sustaining voltage having alternating polarity to (n+1) of display electrodes. These drivers are supplied with a predetermined power from the power source circuit 73 via wiring conductors (not shown).

First Embodiment

[Panel Structure]

Figure 2:
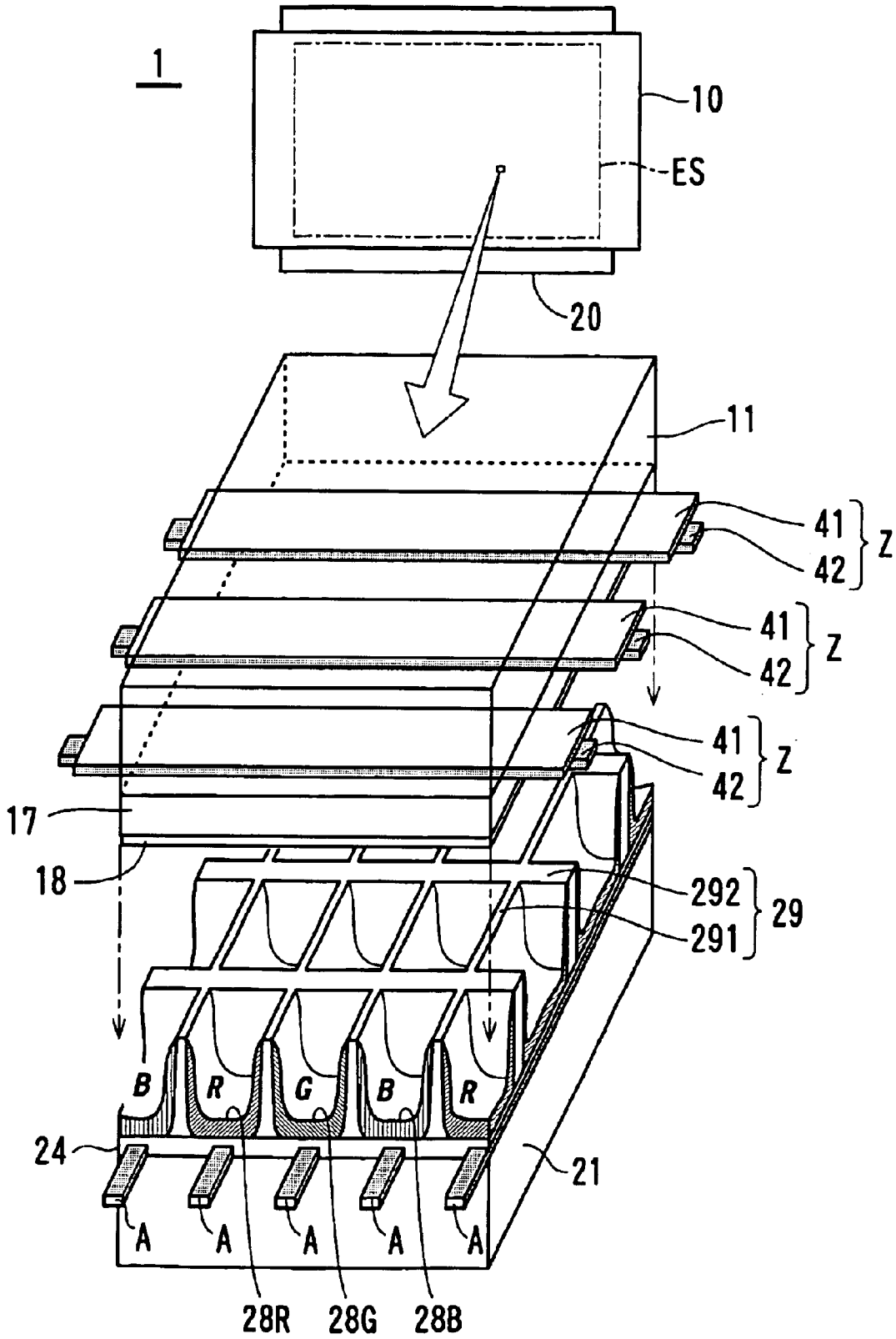
FIG. 2 shows a cell structure of a PDP according to a first embodiment of the present invention.
Figure 3:
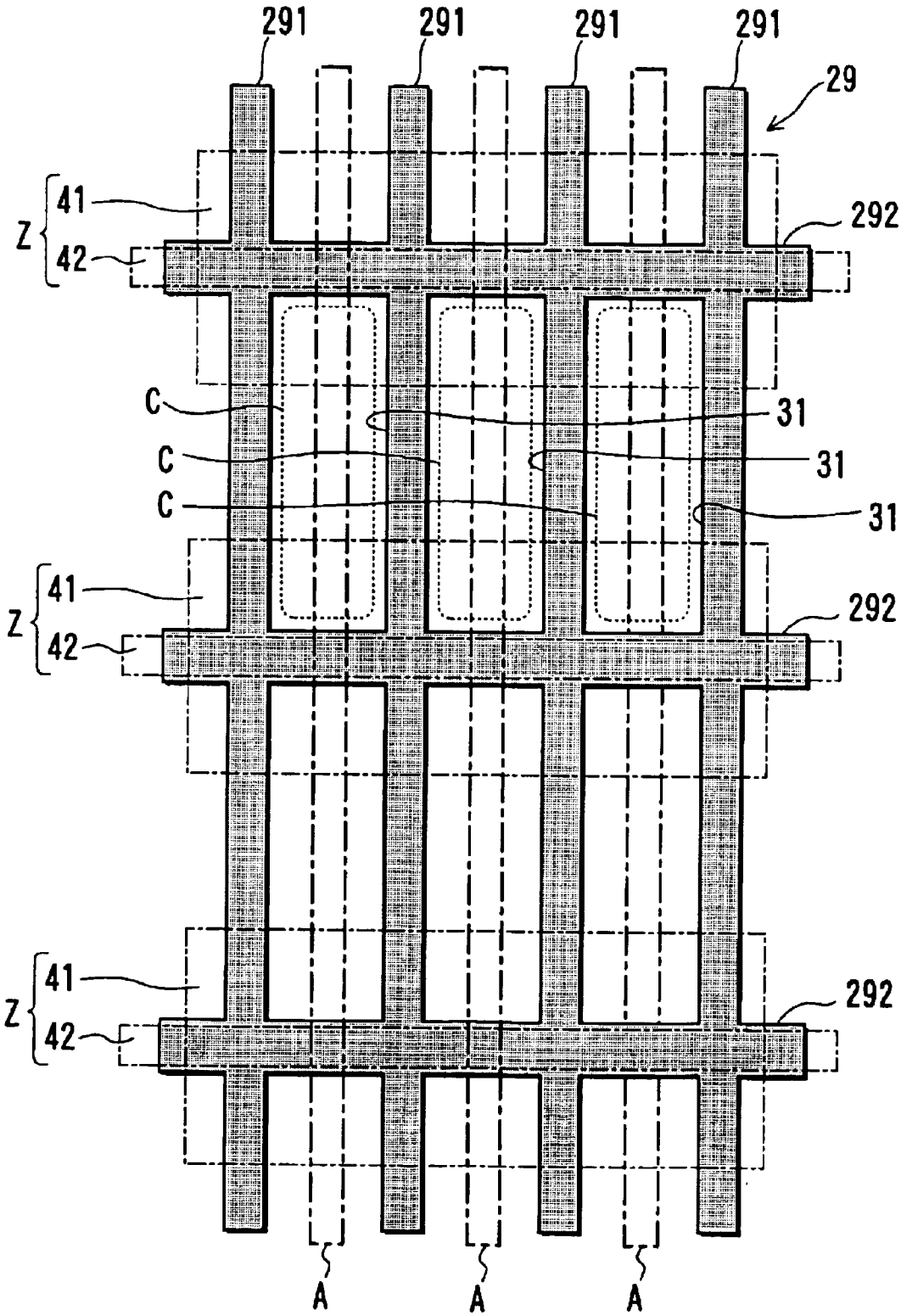
FIG. 3 is a plan view showing a partition pattern of a PDP according to the first embodiment of the present invention.

FIG. 2 shows a cell structure of a PDP according to a first embodiment of the present invention. FIG. 3 is a plan view showing a partition pattern according to the first embodiment of the present invention.

In FIG. 2, the PDP 1 comprises a pair of substrate structures (a structure including a substrate on which elements of cells are arranged) 10, 20. Display electrodes Z are arranged on the inner surface of a glass substrate 11 of a front substrate structure 10 at the same pitch as the row pitch. The total number of the display electrodes Z in the entire display surface ES is the number of rows plus one (n+1). Each of the display electrodes Z except for the ends of the display electrode column is shared by two neighboring rows. The "row" means a group of m (the number of columns) cells having the same arrangement order in the column direction. Each of the display electrodes Z includes a transparent conductive film 41 that forms a surface discharge gap for each cell, and a metal film (a bus conductor) 42 that is overlaid on the middle thereof in the column direction. The metal film 42 is led out of the display surface ES, so as to be connected with the above-mentioned scanning driver 85 and the sustaining driver 89. The display electrode Z is covered with a dielectric layer 17 having a thickness of approximately 10–40 μm, and the dielectric layer 17 is covered with a protection film 18 made of magnesia (MgO).

On the inner surface of a glass substrate 21 of the back substrate structure 20, address electrodes A are arranged one for one row, and the address electrodes A are covered with a dielectric layer 24. A partition 29 having a height of approximately 150 μm is provided on the dielectric layer 24. The partition 29 includes portions for dividing the discharge space for each column (hereinafter referred to as vertical walls) 291 and portions for dividing the discharge space for each row (hereinafter referred to horizontal walls) 292. The surface of the dielectric layer 24 and the side face of the partition 29 are covered with fluorescent substance layers 28R, 28G and 28B of red, green and blue colors for color display. The italic letters R, G and B in FIG. 2 denote light emission colors of the fluorescent substances. The color arrangement has a repeating pattern of red, green and blue colors in which cells of each color have the same color. The fluorescent substance layers 28R, 28G and 28B are excited by ultraviolet rays generated by the discharge gas to emit light.

As shown in FIG. 3, the partition pattern is a grid pattern enclosing each cell C. The grid pattern divides the discharge space 31 substantially into cells and generates no interference of discharge in the column direction in contrast to the stripe pattern. Since the fluorescent substance is formed also on the side face of the horizontal wall 292 of the partition 29, light emission efficiency is enhanced. Since the metal film 42 of the display electrode Z is arranged so as to overlay on the horizontal wall 292 of the partition 29, shading of display light by the metal film 42 can be avoided.

[Driving Method]

Figure 4:
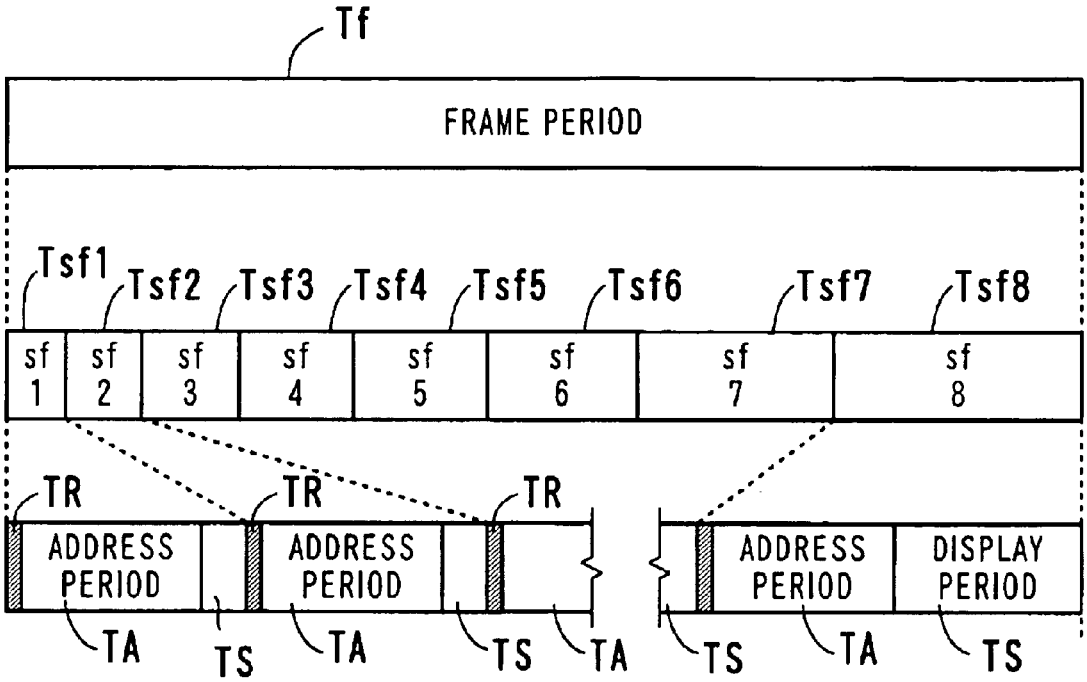
FIG. 4 is a diagram showing a scheme of period setting in the driving method according to the first embodiment.

FIG. 4 is a diagram showing a scheme of period setting in the driving method according to the first embodiment.

The frame period Tf assigned to a frame that is image information of a scene is displayed by the progressive format. In order to reproduce colors by gradation display for each color, one frame is divided into eight subframes, for example. Namely, each frame is replaced with a group of eight subframes. The number of display discharge times of each subframe is set by weighting so that the relative ratio of the luminance in the subframes becomes approximately 1:2:4:8:16:32:64:128. Since combinations of on and off for each subframe can realize 256 steps of luminance setting for each of read, green and blue colors, $256^3$ colors can be displayed. However, it is not necessary to display the subframes in the order of the luminance weight.

Each of the subframe periods Tsf1–Tsf8 assigned to the subframes is divided into a preparation period TR for equalizing a charge distribution of the entire screen, an address period TA for forming an electrification distribution corresponding to a display content, and a display period TS for keeping on state to ensure a luminance corresponding to a gradation level. The preparation period TR and the address period TA are constant regardless of the luminance weight. The display period TS is longer for the larger weight of luminance.

Figure 5:
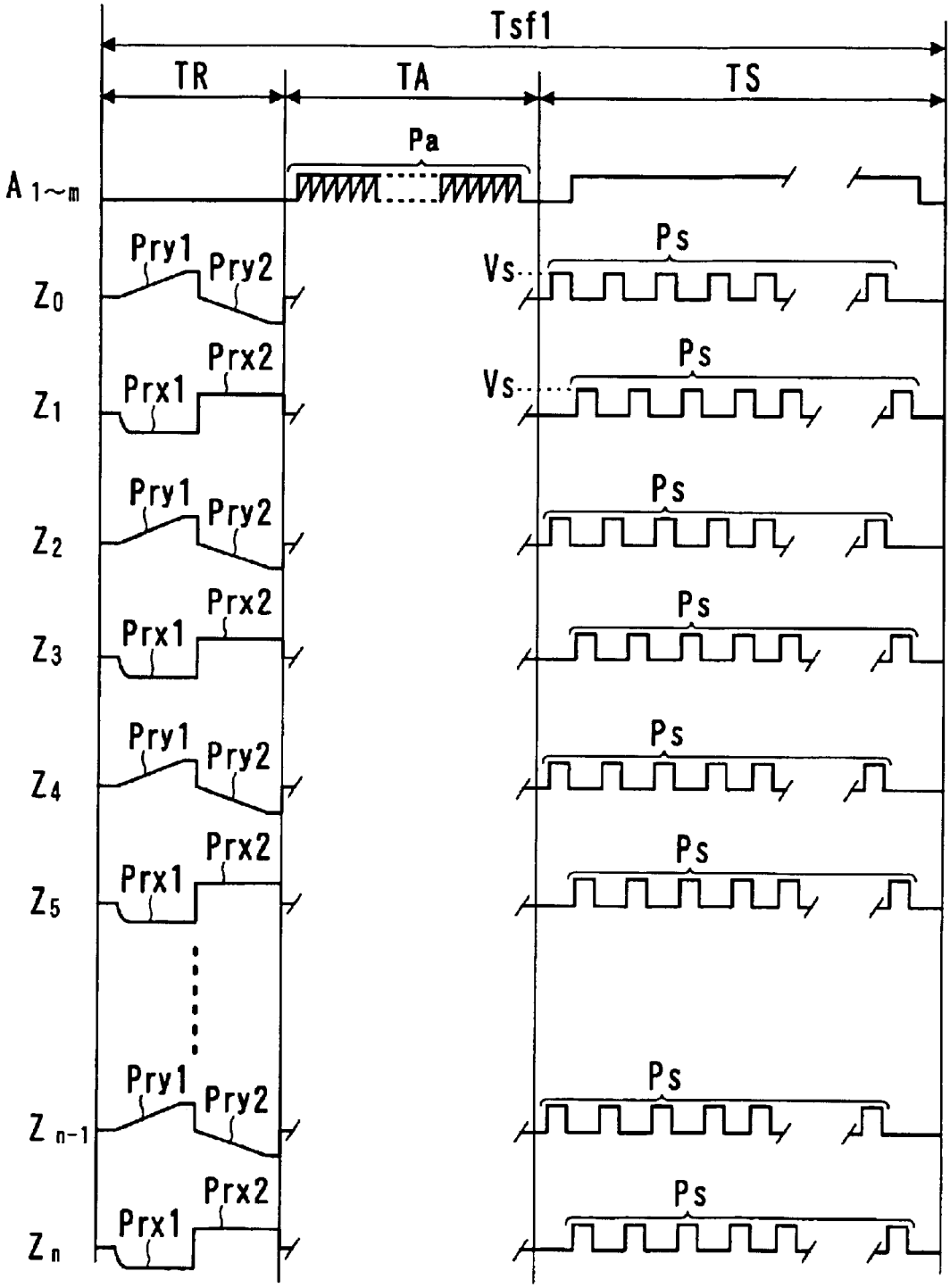
FIG. 5 shows voltage waveforms of a general driving sequence.

FIG. 5 shows voltage waveforms of a general driving sequence. In FIG. 5 and following figures, the suffixes (0, 1, 2, . . . , n) of the reference character of the display electrodes Z indicate the arrangement order of the corresponding rows. The suffixes (1–m) of the reference characters of the address electrodes A indicate the arrangement order of the corresponding columns. The waveform shown in FIG. 5 is an example and can be changed variously in the amplitude, the polarity or the timing.

In the preparation period TR, the pulse Pry1 and the pulse Pry2 having the opposite polarity to each other are applied sequentially to the odd display electrodes Z. The pulse Prx1 and the pulse Prx2 having the opposite polarity to each other are applied sequentially to the even display electrodes Z. The application of a pulse means to bias the electrode temporarily to a potential different from the reference potential (e.g., the ground potential). In this example, each of the pulses Pry1, Pry2 and Prx1 is a ramp waveform pulse or an obtuse waveform pulse increasing in the amplitude for generating a microdischarge. By applying the pulses Prx2 and Pry2, the wall voltage can be regulated to a value corresponding to the difference between the discharge starting voltage and the pulse amplitude. The pulses Prx1 and Pry1 are applied for generating an appropriate wall voltage to the cell that was lighted in the previous subfield and the cell that was not lighted.

In the address period TA, the potential of the display electrode Z is controlled as will be explained later for row selection, and in synchronization with the control an address pulse Pa is applied to the address electrode A corresponding to the cell to be lighted so that an address discharge is generated.

In the display period TS, the odd display electrodes Z and even display electrodes Z are alternately supplied with a sustaining pulse Ps. The amplitude of the sustaining pulse Ps is the sustaining voltage Vs.

Figure 6:
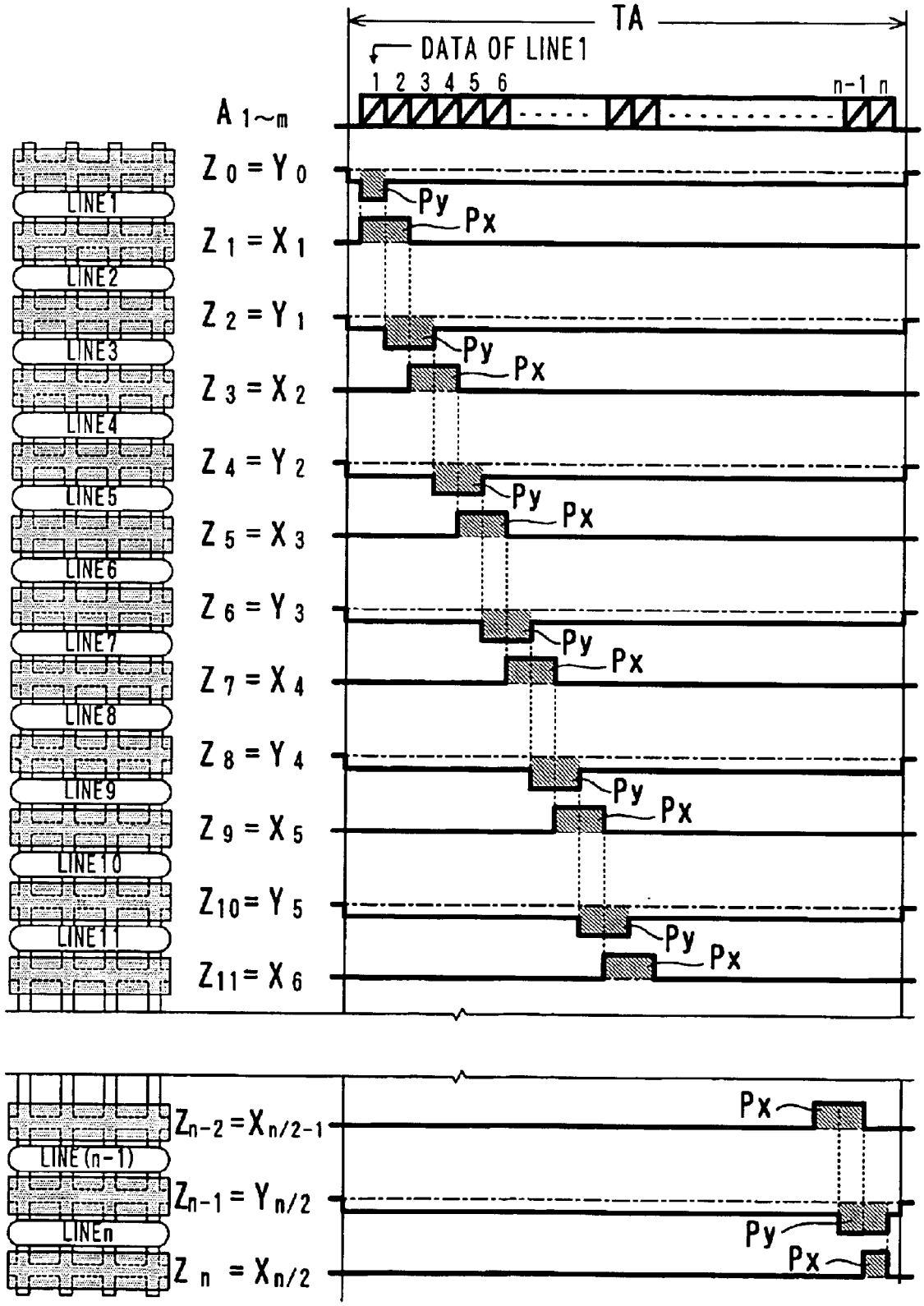
FIG. 6 is a diagram showing the sequence of the voltage control in the addressing according to the first embodiment of the present invention.
Figure 7:
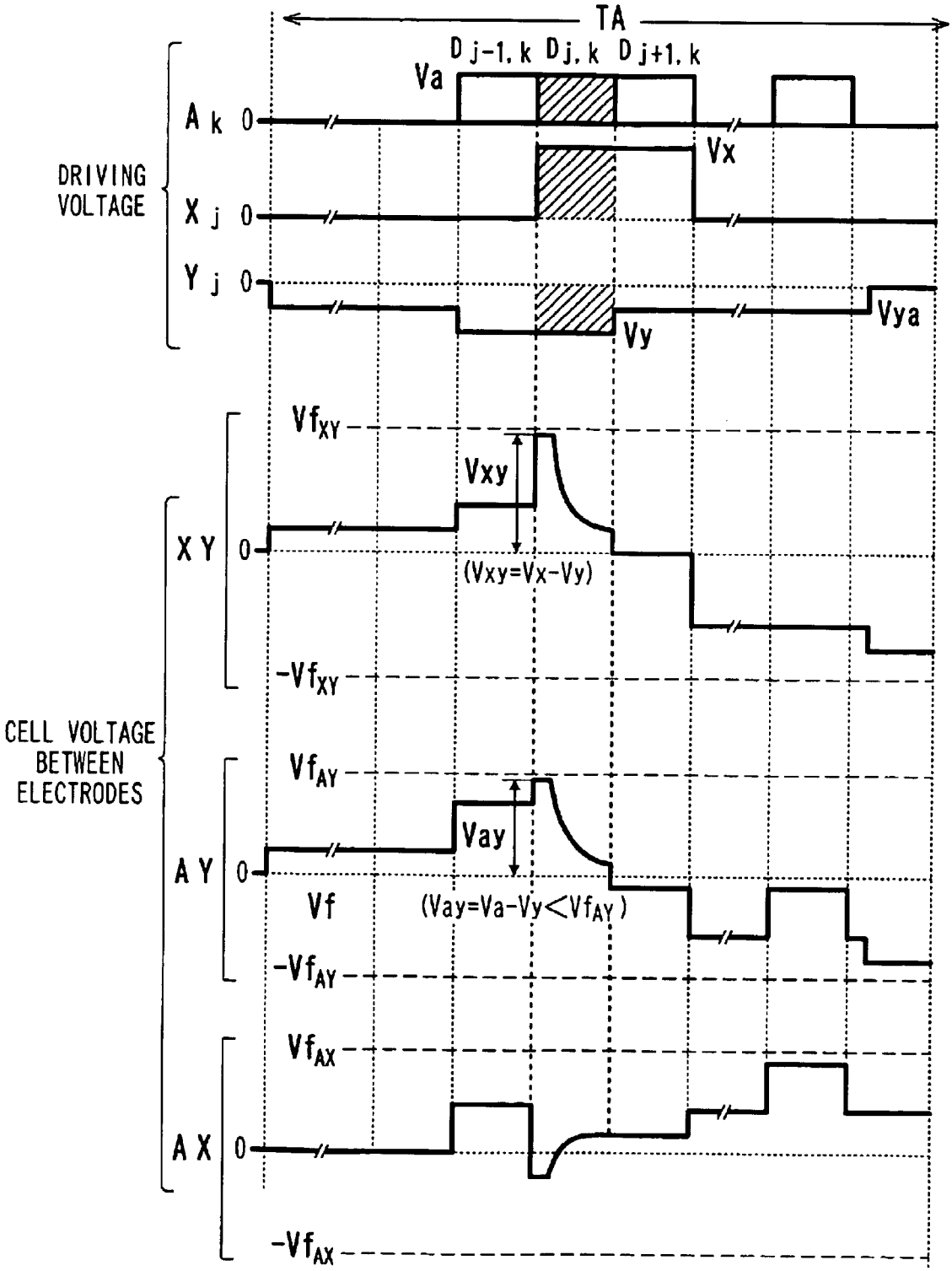
FIG. 7 is a diagram showing waveforms of the cell voltage in the address period.

FIG. 6 is a diagram showing the sequence of the voltage control in the addressing according to the first embodiment of the present invention. FIG. 7 is a diagram showing waveforms of the cell voltage in the address period.

In the first embodiment, each of the display electrodes Z is controlled as scanning electrode independently. Among the (n+1) display electrodes Z, odd display electrodes (corresponds to the display electrodes Y) are supplied sequentially with the scanning pulse Py having the negative polarity, while even display electrodes (corresponding to the display electrodes X) are supplied sequentially with the scanning pulse Px having the positive polarity. The pulse width of the scanning pulse Py and the scanning pulse Px basically corresponds to two rows in the row selection. However, the width of the pulse that is applied to the display electrodes of the both ends of the arrangement can correspond one row, so that the address period TA can be shortened. The application timing of the scanning pulses Py and Px are shifter from each other, so as to overlap only for the time corresponding to one row in the display electrode pair corresponding to each row (indicated with "LINE" in FIG. 6). The period of the double application becomes the selection period of the corresponding row. As shown in FIG. 6, the display electrodes Y and the display electrodes X are supplied with the scanning pulse in the arrangement order, so that n rows are selected in the arrangement order. In the non-selecting period, the display electrode Y or the display electrode X can be biased appropriately for preventing a misdischarge or for reducing the withstand voltage of the driving circuit. In the illustrated example, the display electrode Y is biased.

In synchronization with the row selection by the scanning pulse Py and the scanning pulse Px, the address pulse Pa is applied to the cell to be lighted. An address discharge is generated in the cell to which all of the scanning pulse Py, the scanning pulse Px, and the address pulse Pa are applied.

Figure 20:
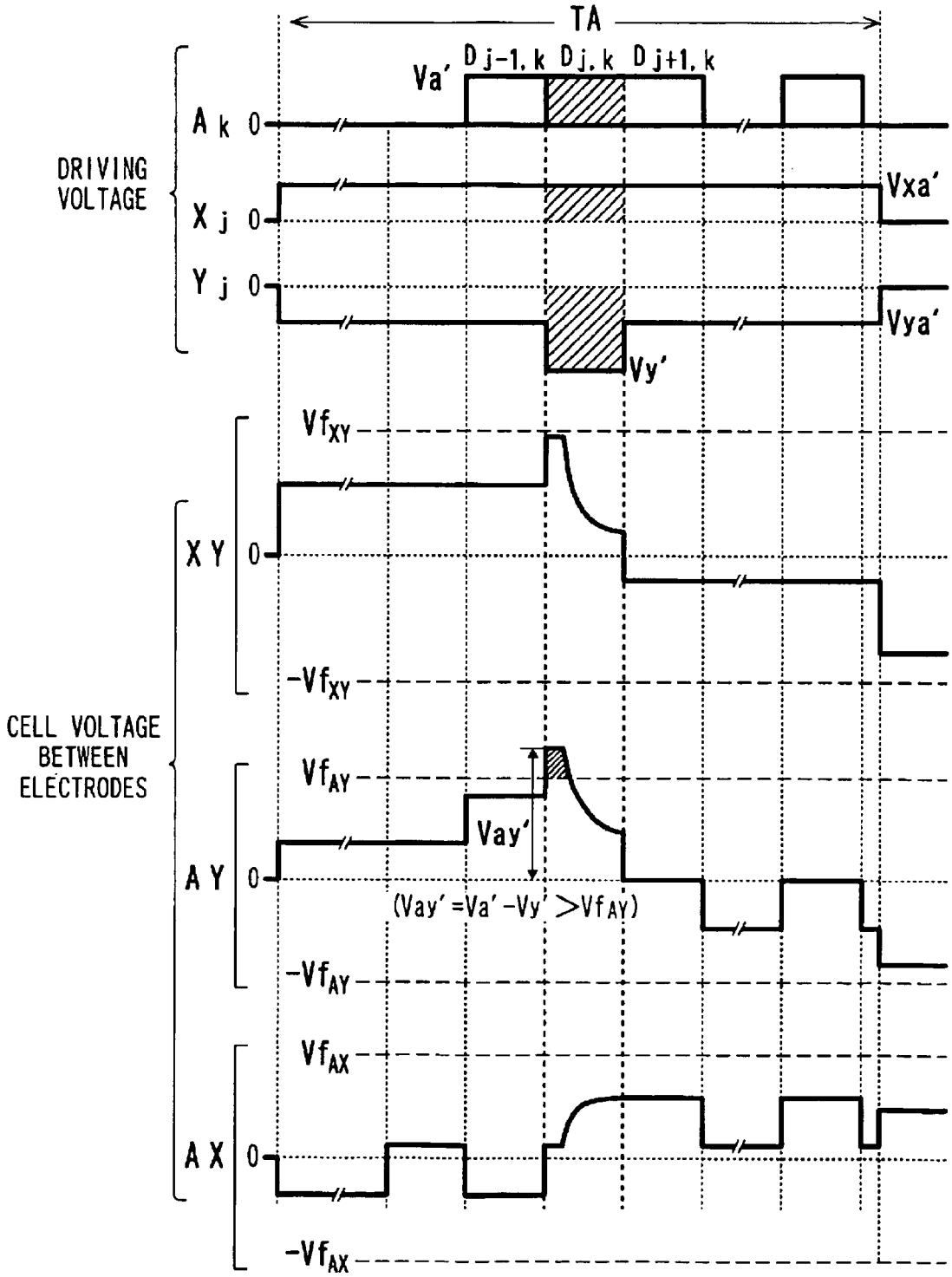
FIG. 20 shows waveforms of cell voltage during the address period in the conventional driving method.

In the above-mentioned sequence it is important that the interelectrode XY between two display electrodes, the interelectrode AY between the address electrode A and the display electrode Y, and the interelectrode AX between the address electrode A and the display electrode X are supplied with voltages that do not exceed the discharge starting voltages $Vf_{XY}$, $Vf_{AY}$ and $Vf_{AX}$, respectively, so that required address discharges are generated. Namely, as being clear from the comparison between FIG. 7 and FIG. 20, though the interelectrode AY is conventionally supplied with the cell-selecting voltage Vay' higher than the discharge starting voltage $Vf_{AY}$, the amplitude of the scanning pulse Py (the selecting potential Vy) and the amplitude of the address pulse Pa (the selecting potential Va) are set in the present invention so that the cell-selecting voltage Vay applied to the interelectrode AY does not exceed the discharge starting voltage $Vf_{AY}$. A concrete example is as follows.

The selecting potential Vx (the amplitude of the scanning pulse Px) is 180 volts.

The selecting potential Vy (the amplitude of the scanning pulse Py) is −100 volts.

The selecting potential Va (the amplitude of the address pulse Pa) is 60–70 volts.

Since cell-selecting voltage Vay applied to the interelectrode AY is lower than the discharge starting voltage $Vf_{AY}$, a discharge is not generated when the row selection voltage Vxy is not applied to the interelectrode XY. When the row selection voltage Vxy is applied, though the row selection voltage Vxy is also lower than the discharge starting voltage $Vf_{XY}$ of the interelectrode XY, a counter discharge is generated at the interelectrode AY by the electric field thereof and the electric field of the cell-selecting voltage Vay. Then, a surface discharge is generated at the interelectrode XY, resulting in the address discharge. The cell voltage of each interelectrode varies along with the wall charge being formed by the address discharge. After the selected row is transferred from j to the next, an address discharge is not generated since there is no overlapping period of the application period of the cell-selecting voltage Vay with that of the row selection voltage Vxy in the row j. Namely, in the row j the charge distribution formed by the addressing is kept until the display period TS.

Second Embodiment

Figure 8:
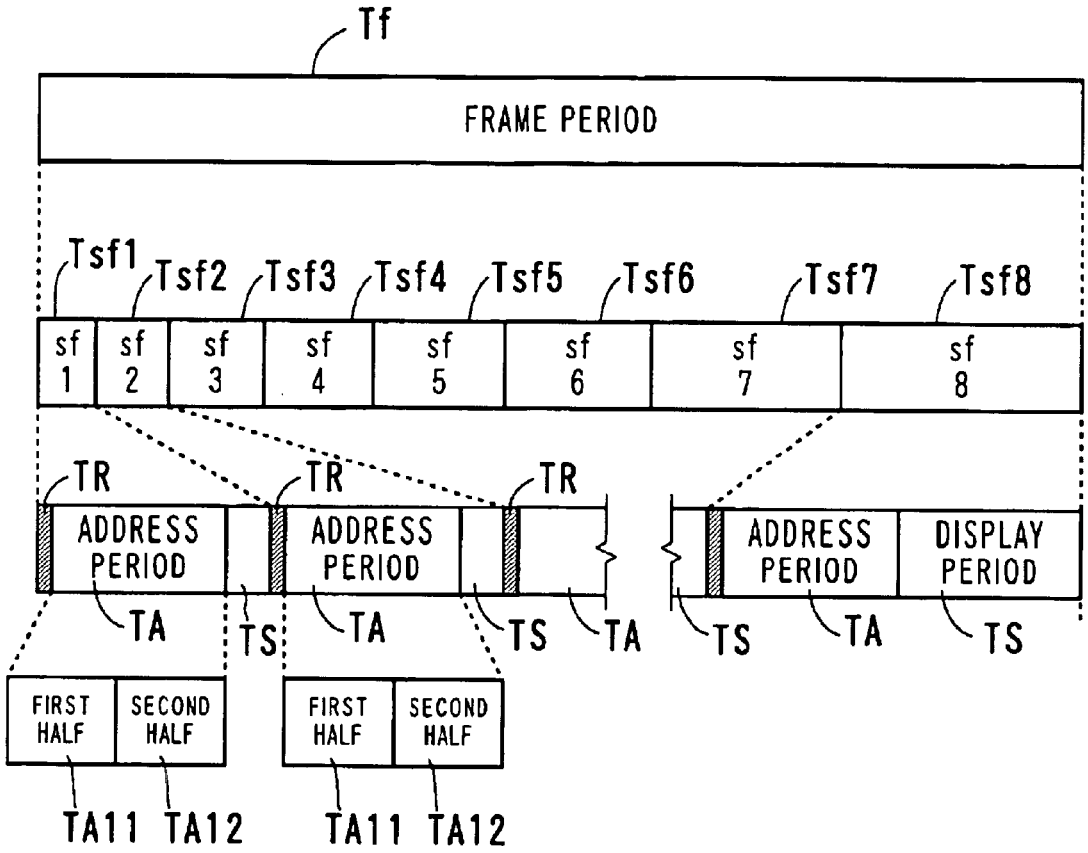
FIG. 8 is a diagram showing a scheme of the period setting in the driving method according to a second embodiment of the present invention.

FIG. 8 is a diagram showing a scheme of the period setting in the driving method according to a second embodiment of the present invention.

In the second embodiment, the period setting is performed in the same way as in the first embodiment. The feature of setting in the second embodiment is to further divide each address period TA of the subframe periods Tsf1–Tsf8 into a first half TA11 and a second half TA12.

Figure 9:
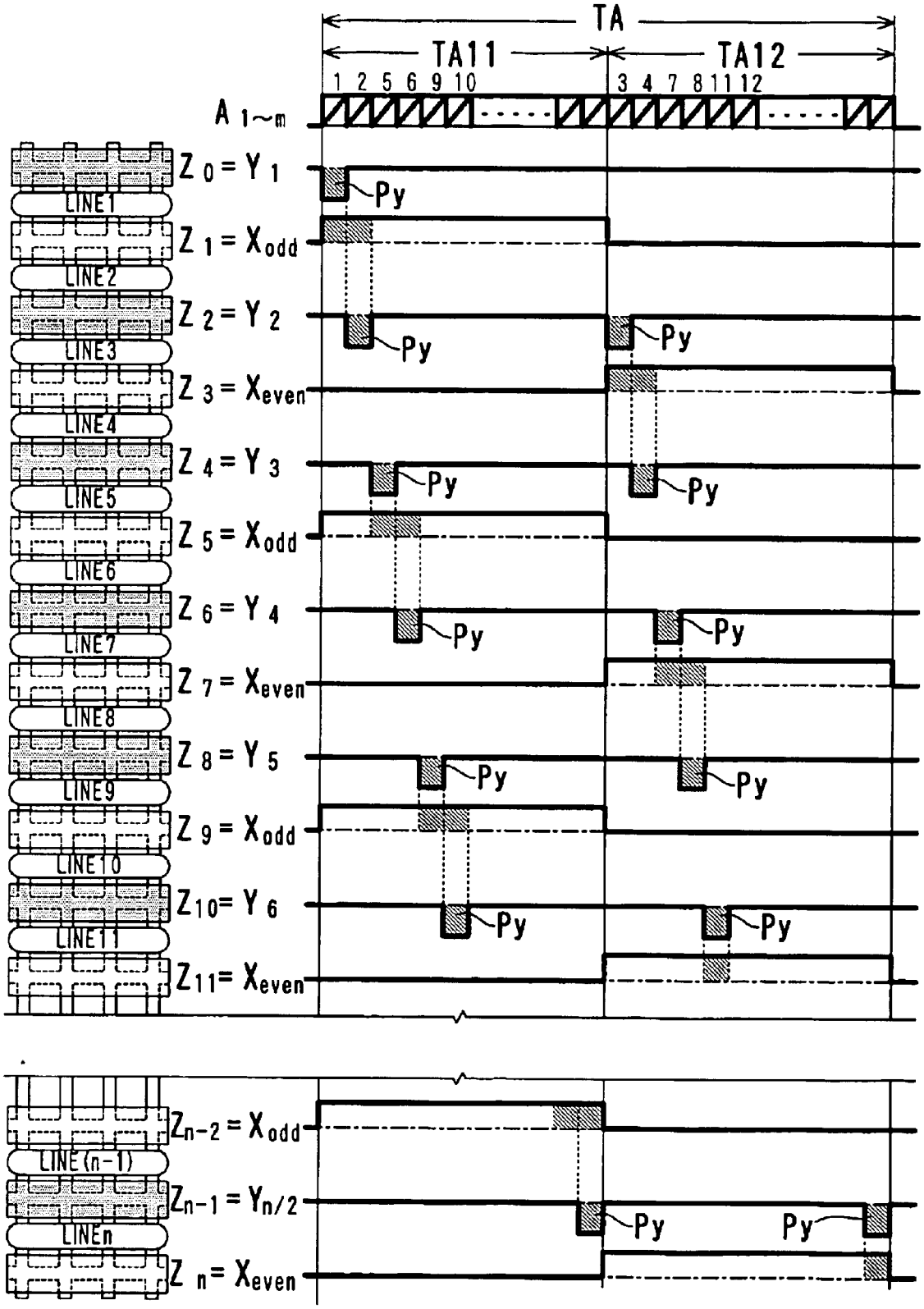
FIG. 9 is a sequence diagram of the voltage control in the addressing of the second embodiment.
Figure 10:
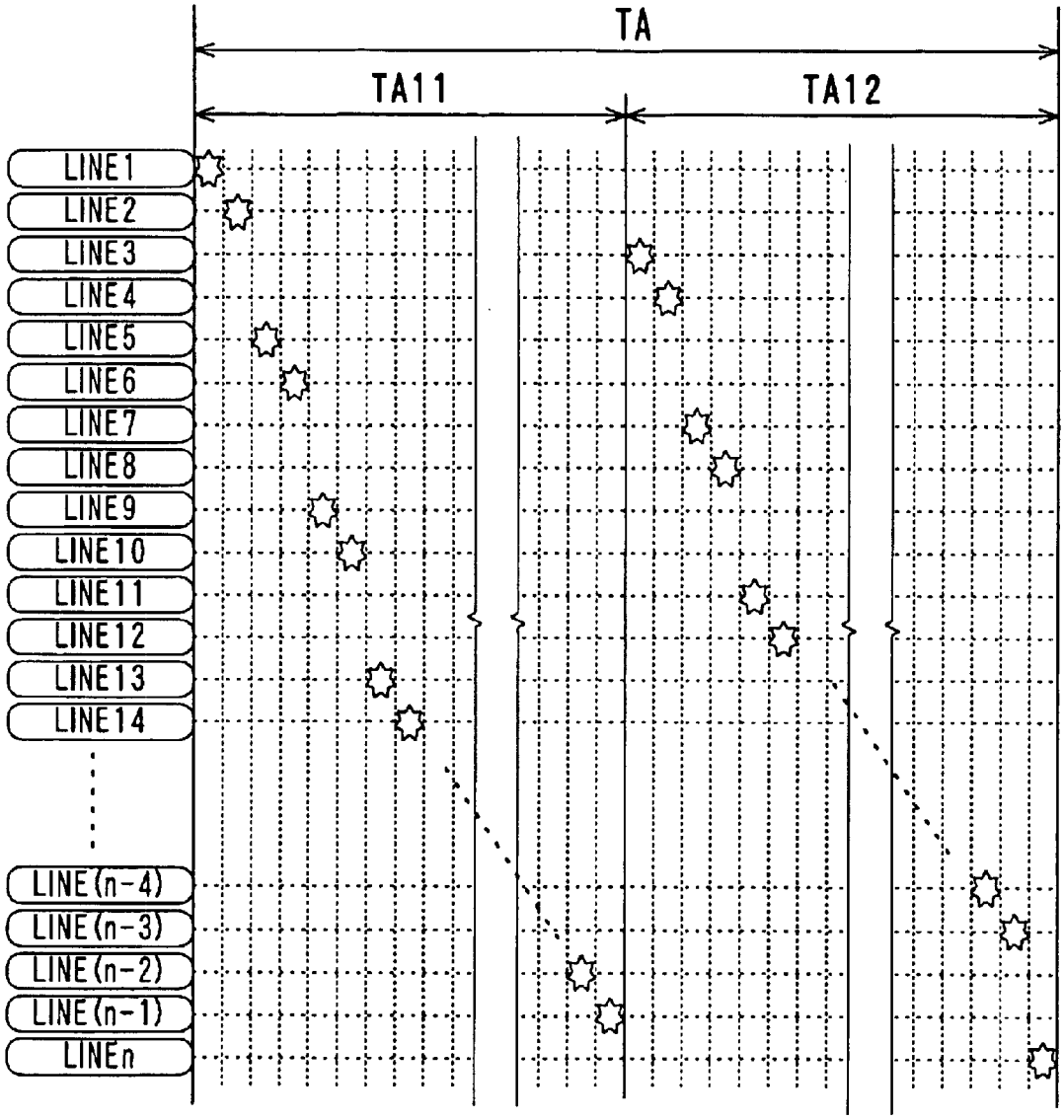
FIG. 10 is a diagram showing an address order of the display lines in the second embodiment.

FIG. 9 is a sequence diagram of the voltage control in the addressing of the second embodiment. FIG. 10 is a diagram showing an address order of the display lines in the second embodiment.

In the second embodiment, among the (n+1) display electrodes Z, odd display electrodes (display electrodes Y) are controlled individually as scanning electrodes. Even display electrodes (display electrodes X) are made common electrodes that do not require individual control. The display electrodes X are classified into a first group (display electrodes $X_{odd}$) and a second group (display electrodes $X_{even}$) in accordance with whether the arrangement order counted by noting only the common electrodes is odd or even.

In the first half TA11 of the address period TA, the display electrodes $X_{odd}$ are biased, while a scanning pulse Py is sequentially applied to all display electrodes Y one by one. When a scanning pulse is applied in the arrangement order of the display electrodes Y, the row selection is performed in which two rows are selected among the four rows from the first row at intervals of two rows as shown in FIG. 10. In synchronization with the row selection of the scanning pulse Py, an address pulse Pa is applied to the address electrode A corresponding to the cell to be lighted. An address discharge is generated in the cell to which the display electrode X is biased, the scanning pulse Py is applied, and the address pulse Pa is applied.

In the second half TA12 of the address period TA, the display electrodes $X_{even}$ are biased, while a scanning pulse Py is sequentially applied to the display electrodes Y except for the head of the arrangement one by one. When the scanning pulse is applied to the display electrode Y in the arrangement order, the row selection is performed in which rows that were not selected in the first half TA11 are selected at intervals of two rows as shown in FIG. 10. In synchronization with the row selection of the scanning pulse Py, an address pulse Pa is applied to the address electrode A corresponding to the cell to be lighted. An address discharge is generated in the cell to which the display electrode X is biased, the scanning pulse Py is applied, and the address pulse Pa is applied.

Also in the addressing of the above-mentioned sequence, each of the three interelectrodes XY, AY and AX is supplied with a voltage that does not exceed the discharge starting voltages thereof, so that a required address discharge is generated. Within the range that satisfies this condition, the first half TA11 and the second half TA12 can be set voltage independently from each other. If an unnecessary charge is generated at the interelectrode AY in the first half TA11, one or both of the bias potential of the display electrode X and the amplitude of the scanning pulse Py in the second half TA12 can be set a little higher than in the first half TA11 for improving the reliability of the addressing. In addition, in order to eliminate the influence of the unnecessary charge a pulse can be applied to the display electrode Y, for example, between the first half TA11 and the second half TA12, so as to generate a discharge for inverting the polarity of the charge.

In the second embodiment, since the display electrodes X are not controlled individually, the necessary components of the scanning circuit are less than in the first embodiment, so the scanning driver 85 can be constituted inexpensively.

Third Embodiment

Figure 11:
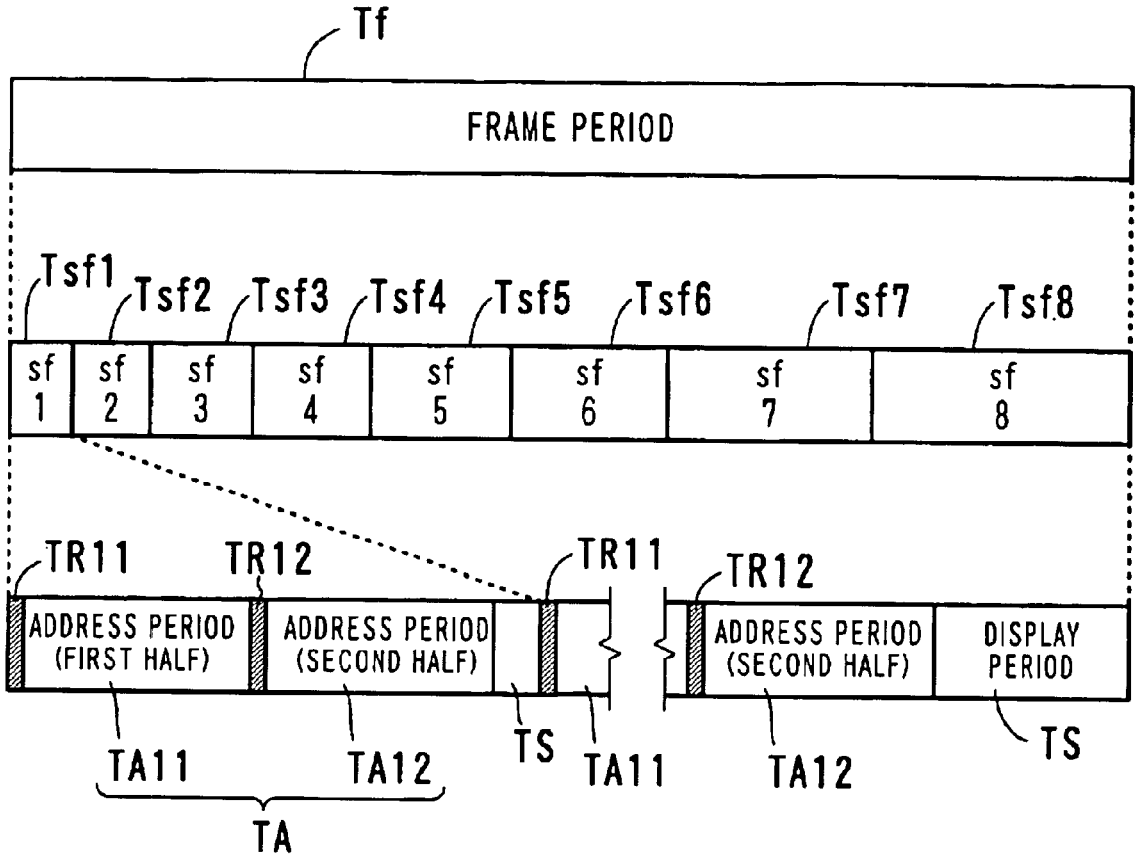
FIG. 11 shows a scheme of the period setting in the driving method according to a third embodiment of the present invention.

FIG. 11 shows a scheme of the period setting in the driving method according to a third embodiment of the present invention.

The period setting of the third embodiment is similar to that of the second embodiment. In the third embodiment, each address period TA of the subframe periods Tsf1–Tsf8 is divided into a first half TA11 and a second half TA12 in the same way as in the second embodiment. The preparation periods TR11 and TR12 are assigned to each of the first half TA11 and the second half TA12. Namely, a preparation period is provided just before the first half TA11 as well as between the first half TA11 and the second half TA12.

Figure 12:
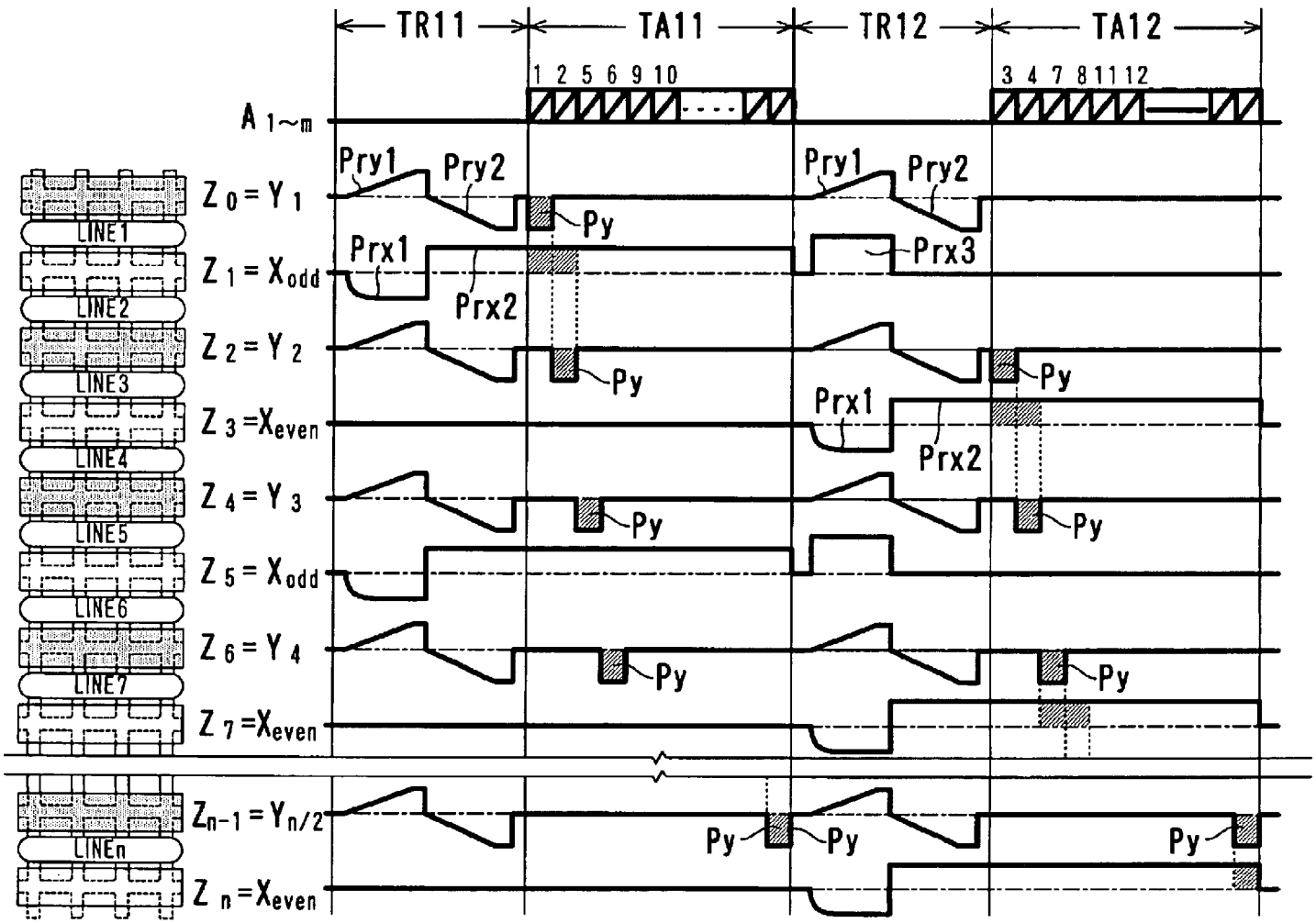
FIG. 12 is a diagram showing the sequence of the voltage control in the addressing of the third embodiment.

FIG. 12 is a diagram showing the sequence of the voltage control in the addressing of the third embodiment.

Also in the third embodiment, among the (n+1) display electrodes Z, odd display electrodes (display electrodes Y) are controlled individually as scanning electrodes. Even display electrodes (display electrodes X) are made common electrodes that do not require individual control. The display electrodes X are classified into a first group (display electrodes $X_{odd}$) and a second group (display electrodes $X_{even}$) in accordance with whether the arrangement order counted by noting only the common electrodes is odd or even.

In the preparation period TR11, the wall charge of the row that is addressed in the ensuing first half TA11 is equalized. All of the display electrodes Y are supplied with the above-mentioned pulses Pry1 and Pry2, and the display electrodes $X_{odd}$ of the first group are supplied with the above-mentioned pulses Prx1 and Prx2. The display electrodes $X_{even}$ of the second group are not supplied with the pulse.

In the first half TA11 of the address period TA, the display electrodes $X_{odd}$ are sustained in the biased state in the same way as in the preparation period TR11, while all display electrodes Y are sequentially supplied with the scanning pulse Py one by one in the same way as in the second embodiment (FIG. 9). When a scanning pulse is applied in the arrangement order of the display electrodes Y, the row selection is performed in which two rows are selected among the four rows from the first row at intervals of two rows as shown in FIG. 10. In synchronization with the row selection of the scanning pulse Py, an address pulse Pa is applied to the address electrode A corresponding to the cell to be lighted. An address discharge is generated in the cell to which the display electrode X is biased, the scanning pulse Py is applied, and the address pulse Pa is applied.

In the preparation period TR12, the wall charge of the row that is addressed in the ensuing second half TA12 is equalized. All display electrodes Y are supplied with the above-mentioned pulses Pry1 and Pry2, and the display electrodes $X_{even}$ are supplied with the above-mentioned pulses Prx1 and Prx2. Concerning the display electrodes $X_{odd}$, in order to keep the charge of the row that has been addressed, a pulse Prx3 having the same polarity with the pulse Pry1 is applied in synchronization with the application of the pulses Pra1 and Pry1 so as to prevent an unnecessary discharge.

In the second half TA12 of the address period TA the display electrodes $X_{even}$ are sustained in the biased state, while all display electrodes Y are sequentially supplied with a scanning pulse Py one by one. When a scanning pulse is applied to the display electrodes Y except for the head in the arrangement order, the row selection is performed in which rows that were not selected in the first half TA11 are selected at intervals of two rows as shown in FIG. 10. In synchronization with the row selection of the scanning pulse Py, an address pulse Pa is applied to the address electrode A corresponding to the cell to be lighted. An address discharge is generated in the cell to which the display electrode X is biased, the scanning pulse Py is applied, and the address pulse Pa is applied.

As explained above, the preparation process is performed twice in the third embodiment, so the reliability of the addressing is high. The display electrode Y that is used as a scanning electrode is a common electrode for two neighboring rows in the electrode arrangement explained with reference to FIG. 2. Therefore, in the address discharge in the first half TA11 in one of the two rows, there is a possibility that the counter discharge is generated at the interelectrode AY in the other row. When the counter discharge is generated and the unnecessary wall charge is formed at the interelectrode AY, the probability that a desired address discharge is not generated due to the influence of the wall charge when the addressing of the row is tried in the second half. Therefore, the second preparation process is performed just before the second half TA12. Thus, the discharge condition is prepared in the first half TA11 and the second half TA12, so that a stable addressing is performed both in the first half TA11 and in the second half TA12.

Also in the third embodiment, since the display electrodes X are not controlled individually in the same way as in the second embodiment, necessary components of the scanning circuit can be less than the first embodiment, so that the scanning driver 85 can be realized inexpensively.

Fourth Embodiment

Figure 13:
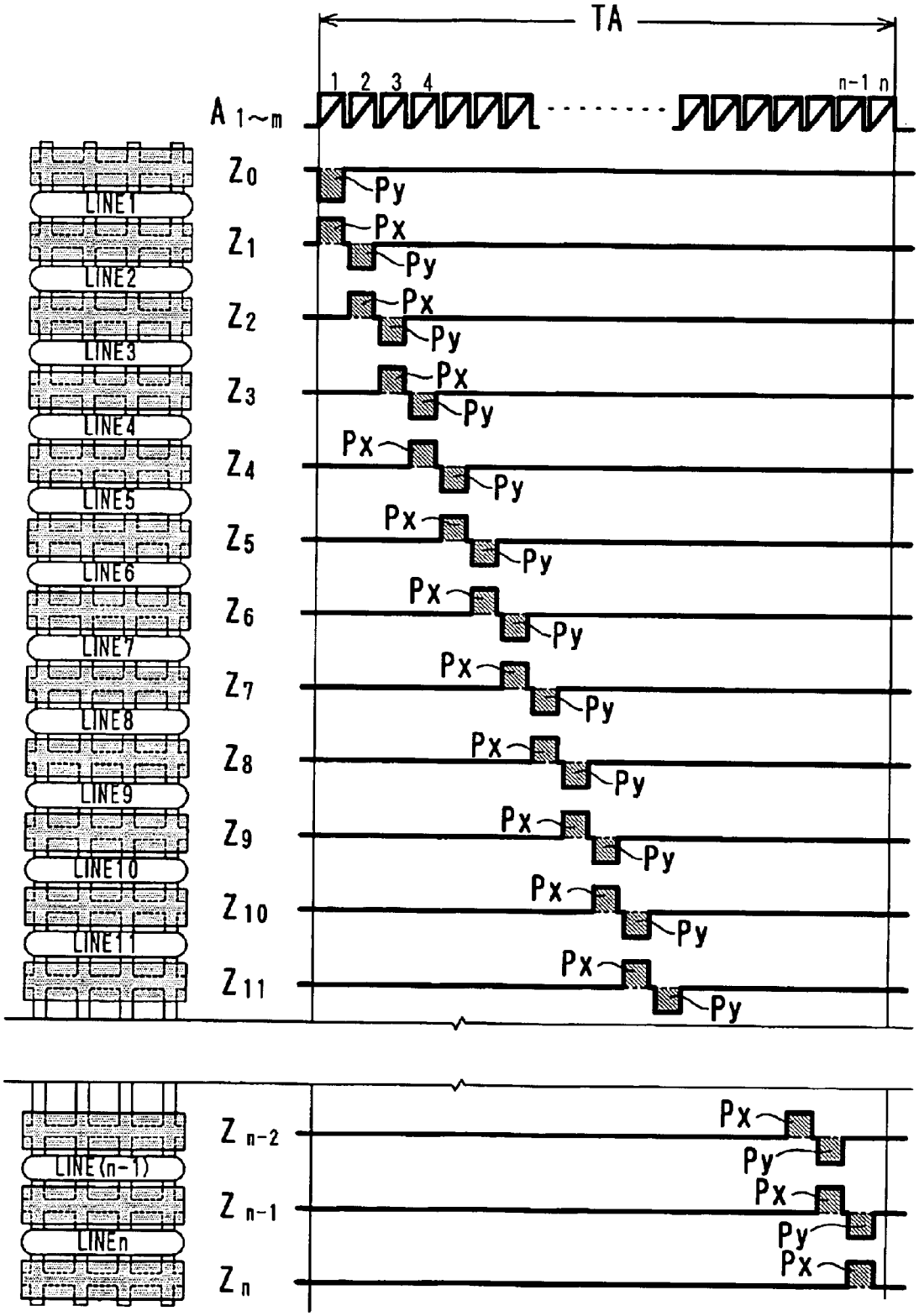
FIG. 13 is a diagram showing the sequence of the voltage control in the addressing of a fourth embodiment of the present invention.

FIG. 13 is a diagram showing the sequence of the voltage control in the addressing of a fourth embodiment of the present invention.

In the fourth embodiment all display electrodes Z are controlled individually as scanning electrodes. Each display electrode Z is supplied with a scanning pulse Px having a first polarity and a scanning pulse Py having a second polarity. One electrode of the display electrode pair corresponding to the selected row is supplied with a scanning pulse Px, and the other electrode is supplied with a scanning pulse Py by setting the application timing. Concerning the display electrodes Z of the ends of the arrangement, one of the scanning pulse Px and the scanning pulse Py is applied. As shown in FIG. 13, when each display electrode Z is supplied with the scanning pulse Px and the scanning pulse Py sequentially, n rows ("LINE" in FIG. 13) are selected in the arrangement order. In synchronization with this row selection, an address pulse Pa is applied to the address electrode A corresponding to the cell to be lighted.

Fifth Embodiment

Figure 14:
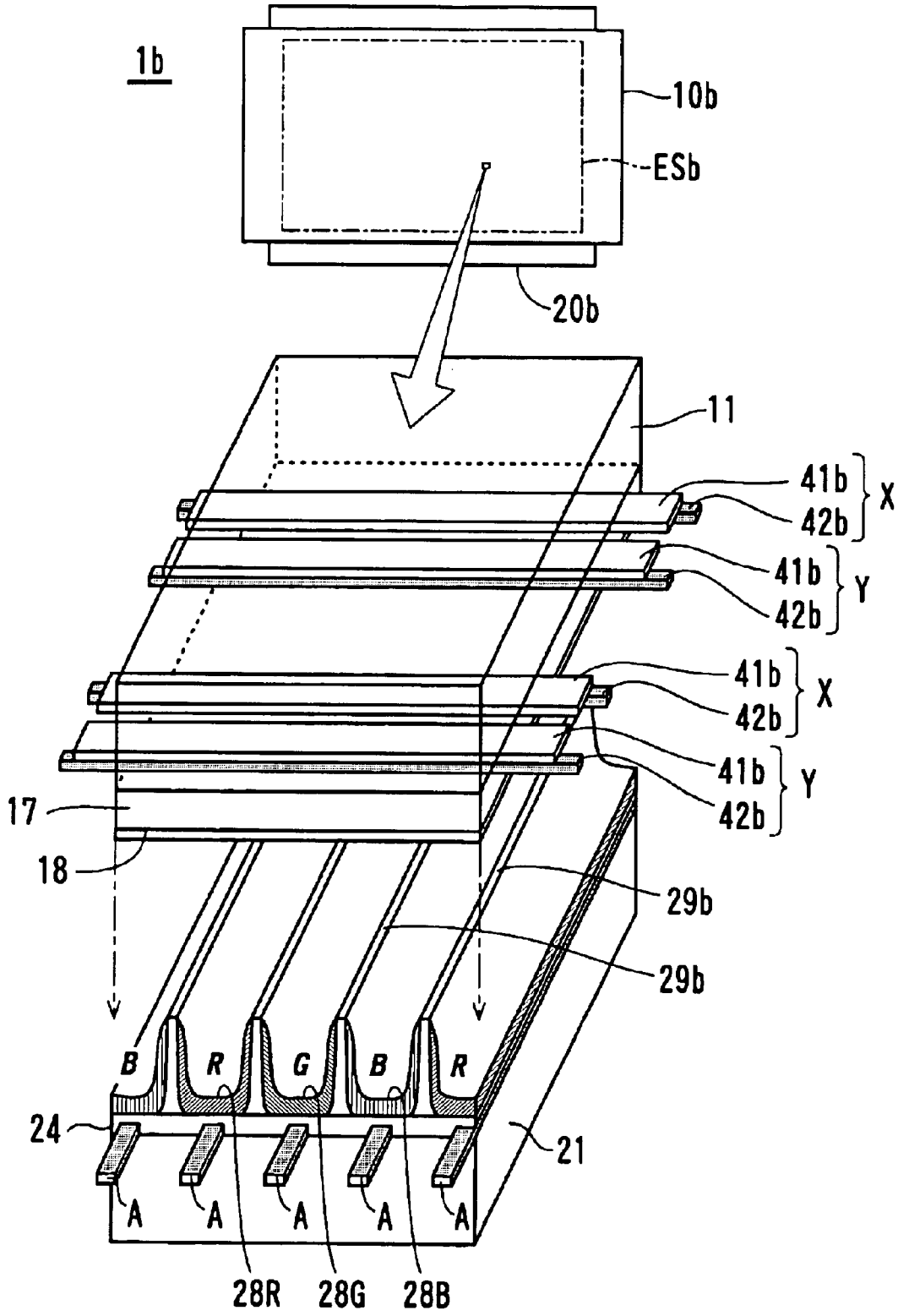
FIG. 14 is a diagram showing a cell structure of a PDP according to a fifth embodiment of the present invention.

FIG. 14 is a diagram showing a cell structure of a PDP according to a fifth embodiment of the present invention.

The PDP 1*b* shown in FIG. 14 comprises a pair of substrate structures 10*b* and 20*b*, which are the same as the above-mentioned PDP 1 except for the arrangement format of the display electrodes and the partition pattern. In the PDP 1*b*, a pair of display electrodes X and Y is arranged for each row of the display surface ESb including n rows and m columns. In the display electrode column arranged on the front glass substrate 11, the electrode gap between the neighboring rows is sufficiently larger than the gap of the display electrode pair (the surface discharge gap). Each of the display electrodes X and Y is formed of a transparent conductive film 41*b* for forming a surface discharge gap and a metal film 42*b* that is overlaid on the edge portion thereof. The display electrodes X and Y are covered with a dielectric layer 17, and the surface thereof is covered with a protection film 18. Though the display electrodes X and the display electrodes Y are arranged alternately (in the pattern of X, Y, X, Y, . . . ) in FIG. 14, the arrangement is not limited to this.

The inner surface of the back glass substrate 21 is provided with address electrodes A each of which is arranged for a column. The address electrodes A are covered with a dielectric layer 24. On the dielectric layer 24, a partition 29*b* having a height of approximately 150 $\mu$m is formed. The partition pattern is a stripe pattern that divides the discharge space for each column. The surface of the dielectric layer 24 and the side face of the partition 29*b* are covered with fluorescent substance layers 28R, 28G and 28B for color display. The italic letters R, G and B in FIG. 14 denote light emission colors of the fluorescent substances. The color arrangement has a repeating pattern of red, green and blue colors in which cells of each color have the same color. The fluorescent substance layers 28R, 28G and 28B are excited locally by ultraviolet rays generated by the discharge gas to emit light.

Figure 15:
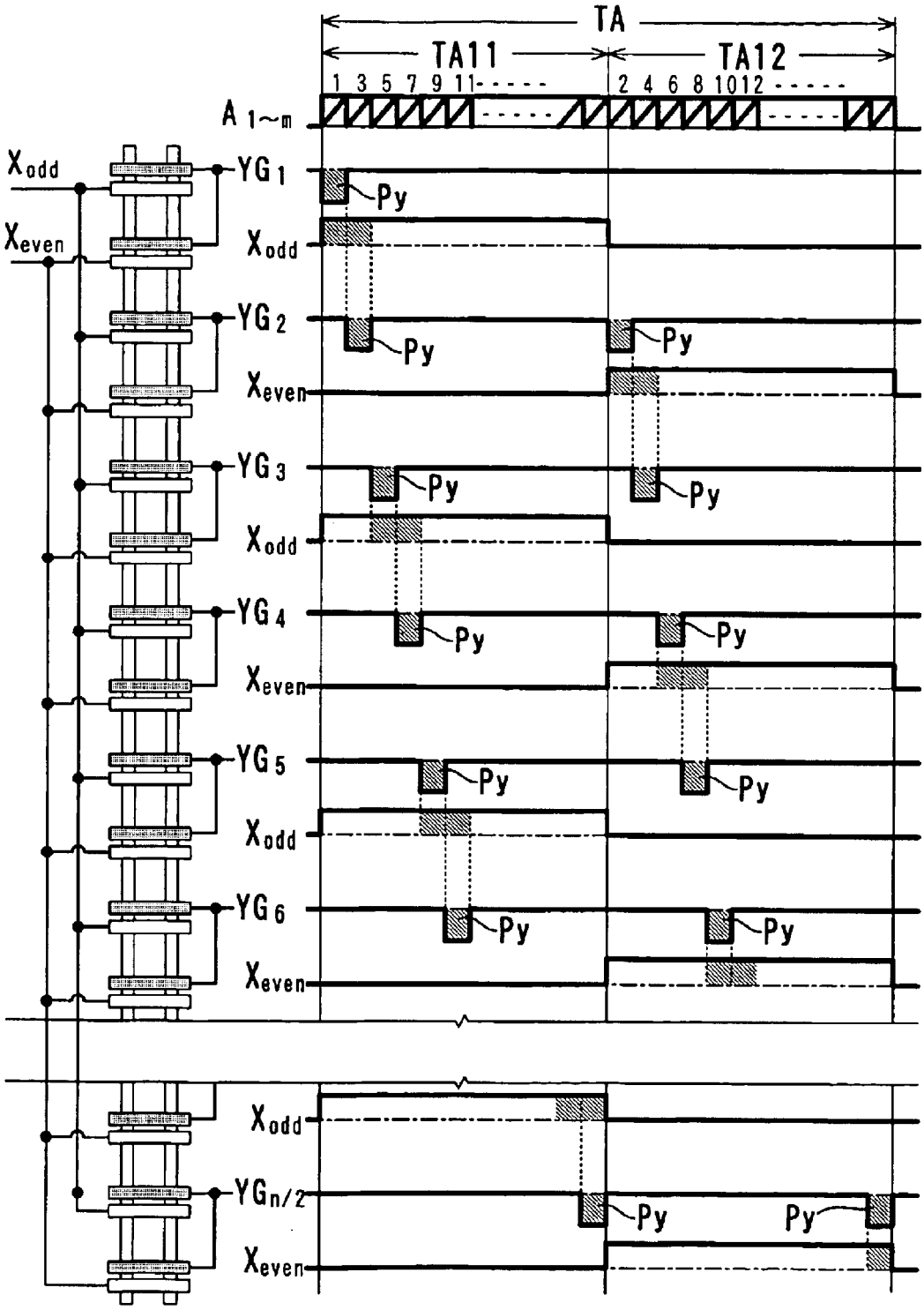
FIG. 15 is a diagram showing the sequence of the voltage control in the addressing according to the fifth embodiment.
Figure 16:
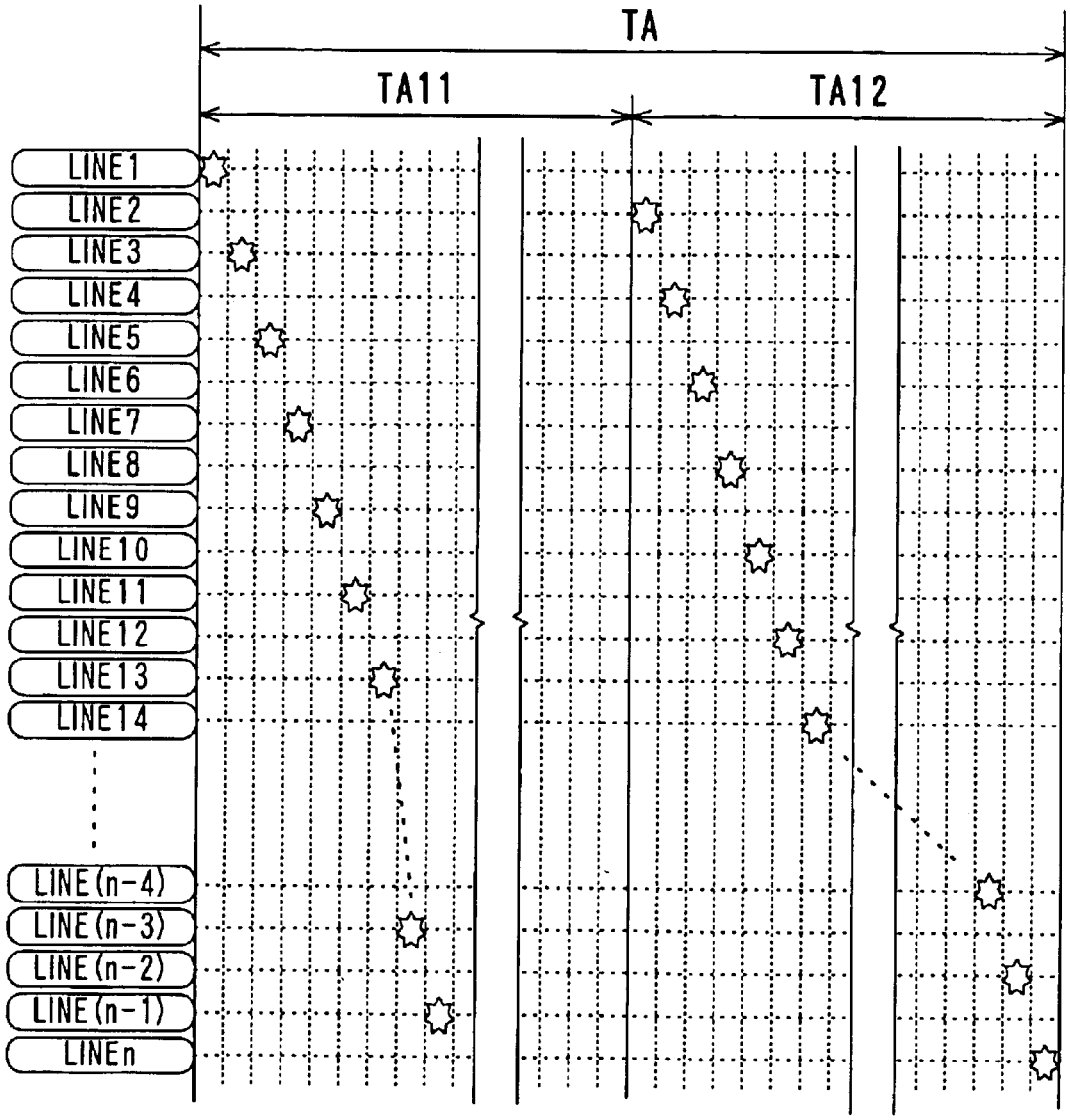
FIG. 16 is a diagram showing the address order of the display lines in the fifth embodiment.

FIG. 15 is a diagram showing the sequence of the voltage control in the addressing according to the fifth embodiment. FIG. 16 is a diagram showing the address order of the display lines in the fifth embodiment.

In the fifth embodiment, n display electrodes Y are divided into groups by two rows so as to make electrically common electrodes. The common display electrodes Y (here, referred to as a display electrode YG) are controlled individually as scanning electrodes. By making common electrodes, the number of necessary components of the scanning circuit is reduced so that the scanning driver becomes less expensive than the conventional driving method in which each row is controlled independently. Concerning the display electrode X, display electrodes X of odd rows make a first group (display electrodes $X_{odd}$), and display electrodes X of even rows make a second group (display electrodes $X_{even}$), so that each group is controlled as a whole.

The voltage control is performed in the sequence similar to the above-mentioned second embodiment for the grouped display electrodes X and Y. Namely, in the first half TA11 of the address period TA, the display electrodes $X_{odd}$ are biased, while all display electrodes YG are sequentially supplied with a scanning pulse Py one by one. When the scanning pulse Py is applied in the arrangement order of the display electrodes YG, the row selection is performed in the order of every other row from the head row as shown in FIG. 16. In the second half TA12, the display electrodes $X_{even}$ are biased, while all display electrodes YG are sequentially supplied with a scanning pulse Py one by one. When the scanning pulse Py is applied in the arrangement order of the display electrodes Y, the row selection is performed in the order of every other row selecting a row that was not selected in the first half TA11 as shown in FIG. 16. In the first half TA11 and the second half TA12, in synchronization with the row selection of the scanning pulse Py, an address pulse Pa is applied to the address electrode A corresponding to the cell to be lighted. An address discharge is generated in the cell to which the display electrode X is biased, the scanning pulse Py is applied, and the address pulse Pa is applied.

Sixth Embodiment

Figure 17:
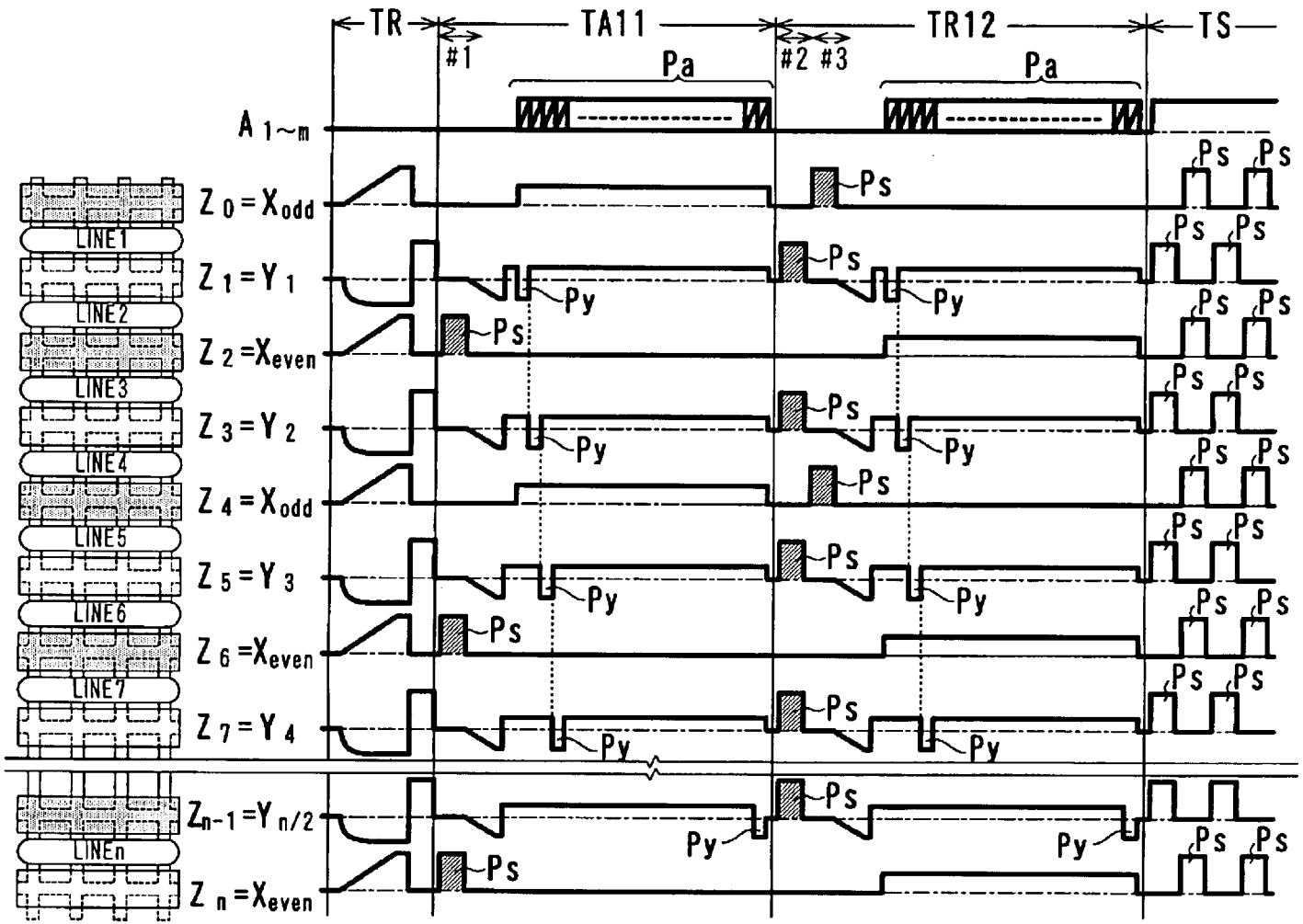
FIG. 17 is a diagram showing the sequence of the voltage control in the addressing of a sixth embodiment of the present invention.
Figure 18:
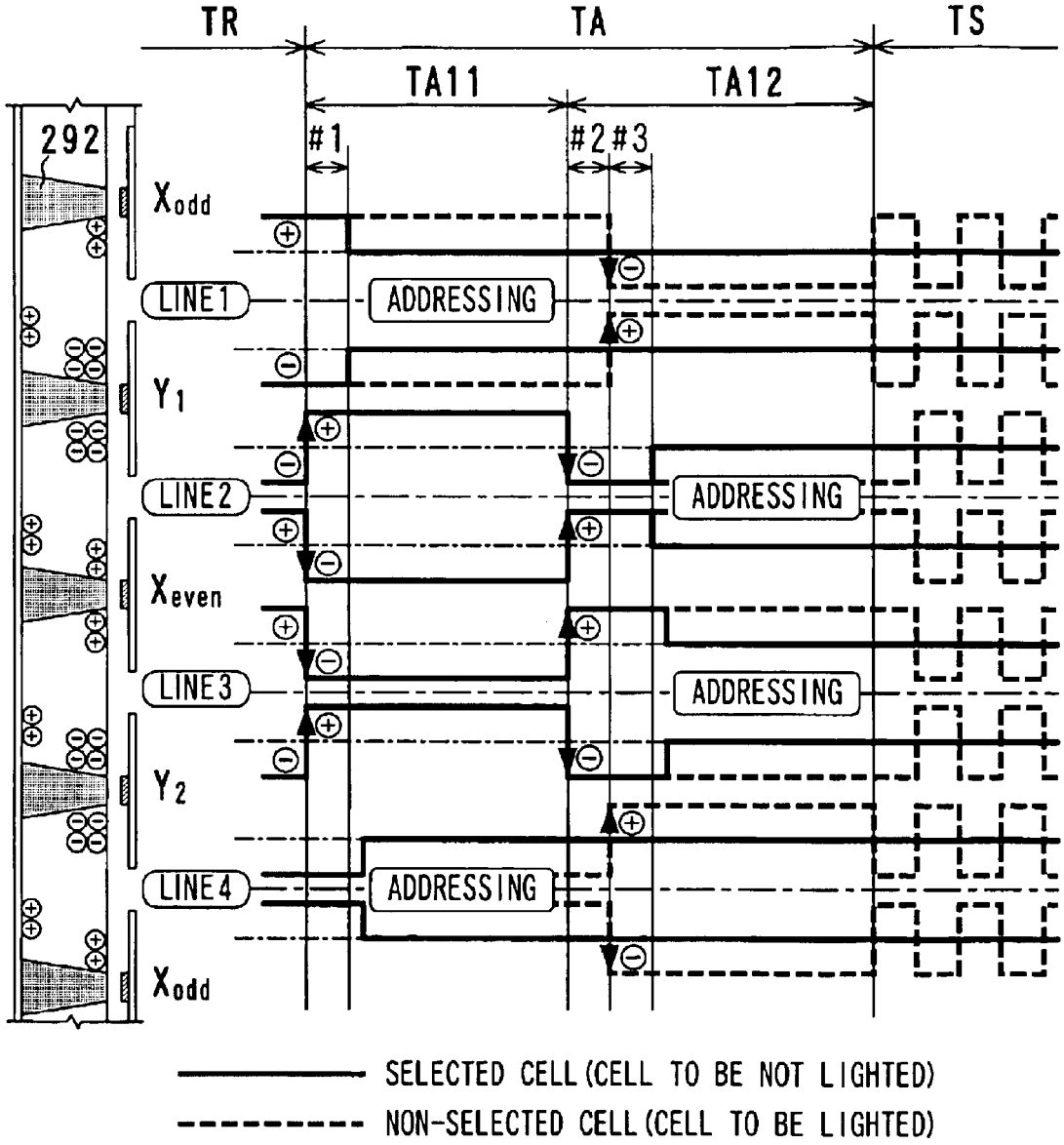
FIG. 18 is a diagram showing a polarity change of the wall charge in the sixth embodiment.
Figure 19:
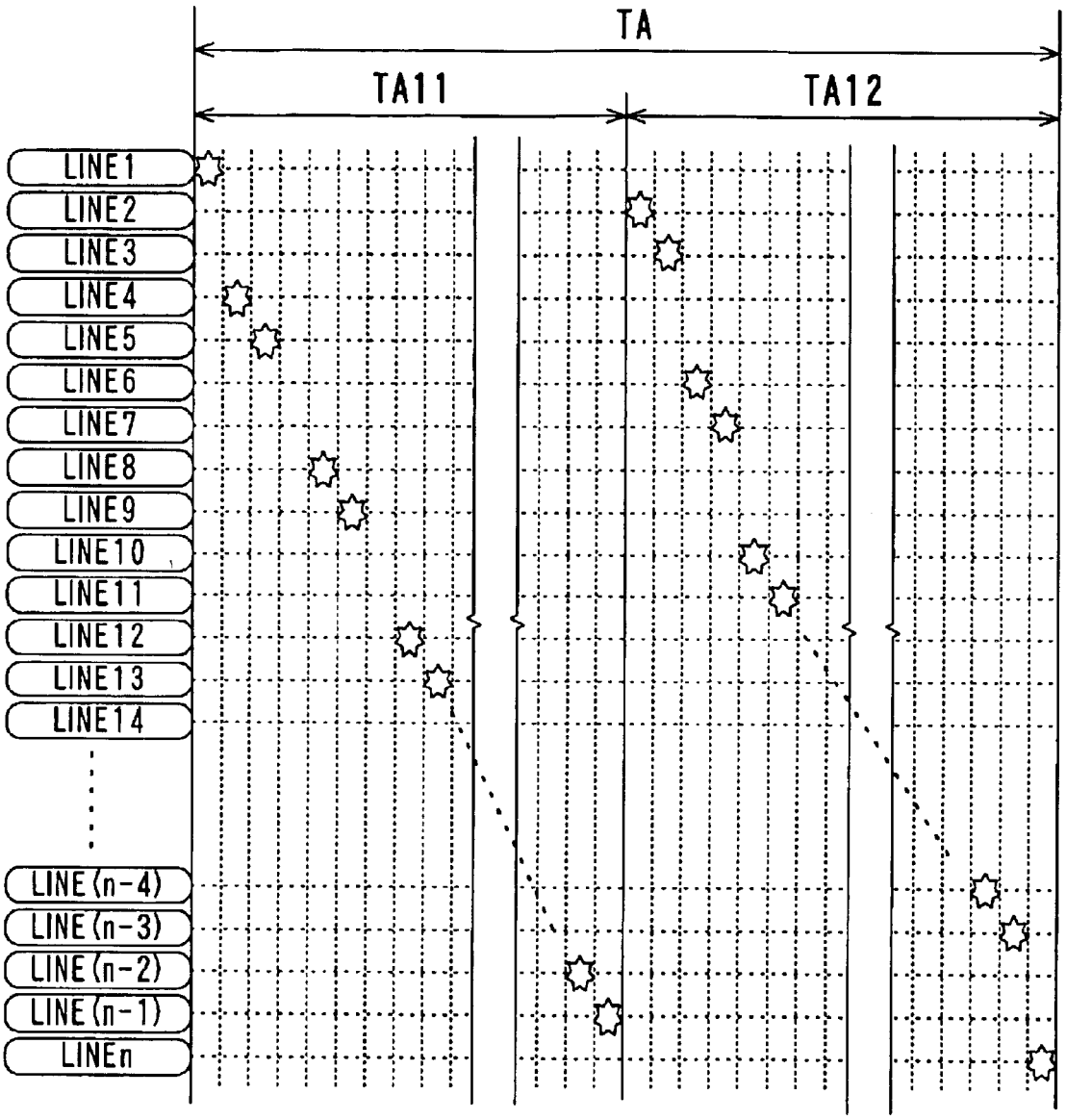
FIG. 19 is a diagram showing an address order of the display lines in the sixth embodiment.

FIG. 17 is a diagram showing the sequence of the voltage control in the addressing of a sixth embodiment of the present invention. FIG. 18 is a diagram showing a polarity change of the wall charge in the sixth embodiment. FIG. 19 is a diagram showing an address order of the display lines in the sixth embodiment.

The sixth embodiment is applied to a PDP 1 having a partition 29 of a grid shape in a plan view for dividing the discharge space for each cell as shown in FIG. 2. The scheme of the period setting in the driving method of the sixth embodiment is similar to that of the second embodiment (FIG. 8).

In the sixth embodiment, among (n+1) display electrodes Z, even display electrodes (display electrodes Y) are controlled individually as scanning electrodes. Odd display electrodes (display electrodes X) are made common electrodes that do not require individual control, and the display electrodes X are classified into a first group (display electrodes $X_{odd}$) and a second group (display electrodes $X_{even}$) in accordance with whether the arrangement order is odd or even counted by noting the common electrodes.

In the preparation period TR, a ramp waveform pulse, an obtuse waveform pulse and a rectangular pulse are combined appropriately to be applied, so that every row generates a wall charge that enables a discharge when the sustaining voltage is applied. The polarity of wall charge at the end of the preparation period TR is plus at the display electrode X side of each row and is minus at the display electrode Y side. Regarding the charge in the vicinity of the display electrodes X and Y, substantially the same quantity of wall charge having the same polarity exists at both sides of horizontal wall 292 as shown in FIG. 18.

Referring to FIG. 17, in the first half TA11 of the address period TA, a sustaining pulse Ps having the amplitude Vs and the positive polarity is applied to the display electrodes $X_{even}$ first (#1). Thus, in the row to which the display electrodes $X_{even}$ are related (to be addressed in the second half TA12), a discharge is generated so that the polarity of the wall charge is inverted. The discharge is localized for each row by the horizontal wall 292. Regarding the charge in the vicinity of each display electrode Y, the polarity at the display electrodes $X_{even}$ side is inverted with respect to the boundary of the horizontal wall 292, while the polarity at the display electrodes $X_{odd}$ side is not inverted. Following this wall charge control, the potentials of all display electrodes Y are altered gradually to the selecting potential (Vy) having the negative polarity and are biased to the non-selecting potential (Vsc), while the display electrodes $X_{odd}$ are biased to the selecting potential (Vax). In this state, all display electrodes Y are sequentially supplied with a scanning pulse Py1 one by one. Namely, the display electrode Y of the selected row is temporarily biased to the selecting potential (Vy). When the scanning pulse Py is applied in the arrangement order of the display electrode Y, the selection of two rows is performed at intervals of two rows after selecting the head row as shown in FIG. 19. In synchronization with the row selection of the scanning pulse Py, an address pulse Pa is applied to the address electrode A corresponding to the cell to be not lighted in the later display period TS (the selected cell). An address discharge is generated in the cell to which the display electrode X is biased, the scanning pulse Py is applied, and the address pulse Pa is applied, so that the wall charge disappears as shown in the solid line in FIG. 18. The address pulse Pa is not applied to the cell to be lighted (the non-selected cell), and the wall charge remains as shown in the broken line in FIG. 18.

It is important that the addressing is performed only for one row despite each display electrode Y is common to two neighboring rows. As explained above, prior to the row selection the polarity of the wall charges in the rows to which the display electrodes $X_{even}$ are related is inverted, so that the wall charge in the rows works so as to cancel the scanning pulse Py. Therefore, the address discharge is not generated.

In the second half TA12 of the address period TA, all display electrodes Y are supplied with the sustaining pulse Ps first, so that the polarity of the wall charge in the row to which the display electrodes $X_{even}$ are related is inverted again (#2). Namely, the charged state of the cell to be addressed in the second half TA12 is returned to the state at the end of the preparation period TR. Then, the display electrodes $X_{odd}$ are supplied with a sustaining pulse Ps (#3). Thus, a discharge is generated in the non-selected cell of the row that was selected in the first half TA11, so that the polarity of the remaining wall charge is inverted. Following this wall charge control, the potentials of all display electrodes Y are gradually altered to the selecting potential (Vy) and then are biased to the non-selecting potential (Vsc), so that the display electrodes $X_{even}$ are biased to the selecting potential (Vax). In this sate, all display electrodes Y are sequentially supplied with a scanning pulse Py one by one. When the scanning pulse Py is applied in the arrangement order of the display electrode Y, the rows that were not selected in the first half TA11 are selected sequentially as shown in FIG. 19. In synchronization with the row selection of the scanning pulse Py, the address pulse Pa is applied to the address electrode A corresponding to the selected cell to generate an address discharge. Since the polarity of the wall charge is previously inverted for the nontarget rows in the same way as in the first half TA11, the wall charge works so as to cancel the scanning pulse Py. Therefore, an address discharge is not generated in the nontarget rows.

The practical example of the bias potential is as follows.

Vs is 160–190 volts

Vy is −40–−90 volts

Vsc is 0–60 volts

Vax is 0–80 volts

In the display period TS, all display electrodes Y are supplied with a sustaining pulse Ps at the same time. Thus, a display discharge is generated in the row related to the display electrode Y and the display electrode $X_{odd}$. After that, all display electrodes X ($X_{odd}$+$X_{even}$) and all display electrodes Y are supplied with the sustaining pulse Ps alternately. A display discharge is generated every application in the row having a non-selected cell.

According to the present invention, a progressive display can be realized in the electrode structure in which two neighboring rows share a display electrode. In addition, components of the scanning circuit are reduced and the driving circuit can be less expensive. Furthermore, a stable progressive display without an interference of the discharge disturbing a display can be realized. Furthermore, the reliability of the addressing can be improved, and a more stable progressive display can be realized.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving a plasma display panel in which a plurality of display electrodes constitutes an electrode pair for a surface discharge of each row and is arranged so that one electrode is shared by two neighboring rows for display, and a plurality of address electrodes is arranged so as to cross the electrode pair in each column, the method comprising:

performing addressing by controlling a potential of the address electrode in accordance with display data in parallel with row selection for biasing one display electrode of the electrode pair corresponding to a selected row to a selecting potential temporarily;

making a cell-selecting voltage applied to interelectrode AY between the display electrode and the address electrode for the addressing lower than a discharge starting voltage of the interelectrode AY; and applying a row selection voltage that is lower than a discharge starting voltage of interelectrode XY between the display electrodes of the electrode pair corresponding to the selected row to interelectrode XY so as to generate an address discharge.

2. The method according to claim 1, further comprising biasing one display electrode of each electrode pair to the selecting potential for the row selection period of two rows, biasing the other display electrode to the potential for applying the row selection voltage for the row selection period of two rows, and overlapping the bias period of one display electrode with the bias period of the other display electrode for the row selection period of one row.

3. The method according to claim 1, wherein the display electrode that is biased to the selecting potential for the row selection is biased so as to reduce the voltage of the interelectrode XY in a non-selecting period.

4. The method according to claim 1, further comprising:

classifying the plural display electrodes into two groups in accordance with whether an arrangement order of the display electrodes is odd or even;

making the display electrodes belonging to one group to be scan electrodes that can be controlled independently;

making the display electrodes belonging to the other group to be common electrodes that do not need independent control;

classifying the common electrodes into a first group and a second group in accordance with whether an arrangement order of the common electrodes is odd or even, in the common electrodes;

dividing an address period for performing the addressing into a first half and a second half;

performing row selection in the first half in which the common electrodes of the first group are biased as a whole and all scan electrodes are biased, one by one; and performing row selection in the second half in which the common electrodes of the second group are biased as a whole and all scan electrodes are biased, one by one.

5. The method according to claim 4, further comprising the step of setting different values of at least one of the cell-selecting voltage applied to the interelectrode AY and the row selection voltage applied to the interelectrode XY between the first half and the second halt.

6. A display apparatus, comprising:

a plasma display panel in which a plurality of display electrodes constitutes an electrode pair for a surface discharge of each row and is arranged so that one electrode is shared by two neighboring rows for display, and a plurality of address electrodes is arranged so as to cross the electrode pair in each column; and an electric circuit for controlling the plasma display panel in accordance with the driving method of claim 1.

7. The display apparatus according to claim 6, wherein the plasma display panel includes a partition having a grid shape in a plan view for dividing the discharge space for each cell.

8. A method for driving a plasma display panel in which a plurality of display electrodes constitutes an electrode pair for a surface discharge of each row and is arranged so that one electrode is shared by two neighboring rows for display, and a plurality of address electrodes is arranged so as to cross the electrode pair in each column, and a partition having a grid shape in a plan view for dividing the discharge space for each cell is provided, the method comprising:

classifying the plural display electrodes into two groups in accordance with whether an arrangement order of the display electrodes is odd or even;

making the display electrodes belonging to one group scan electrodes that can be controlled independently;

classifying the display electrodes belonging to the other group into a first group and a second group in accordance with whether an arrangement order of the electrodes belonging to the other group is odd or even, in the display electrodes belonging to the other group;

dividing an address period into a first half and a second half, the address period being for performing the addressing by controlling a potential of the address electrodes in accordance with display data in parallel with row selection for biasing one display electrode of the electrode pair corresponding to a selected row to a selecting potential temporarily; and providing a preparation period for equalizing respective charges adjacent to the first half and adjacent to the second half.

9. The method according to claim 8, further comprising:

performing row selection in the first half in which the display electrodes of the first group are biased as a whole and all scan electrodes are biased one by one;

performing row selection in the second half in which the display electrodes of the second group are biased as a whole and all scan electrodes are biased one by one;

making a cell-selecting voltage applied to interelectrode AY between the display electrode and the address electrode for the addressing lower than a discharge starting voltage of the interelectrode AY; and applying a row selection voltage that is lower than a discharge starting voltage of interelectrode XY to the interelectrode XY between the display electrodes of the electrode pair corresponding to the selected row so as to generate an address discharge.

10. A method for driving a plasma display panel in which a plurality of first display electrodes and a plurality of second display electrodes are arranged so as to constitute electrode pairs for surface discharges independently in rows, and a plurality of address electrodes is arranged so as to cross the electrode pair in each column, the method comprising:

classifying the plural first display electrodes into a first group and a second group in accordance with whether an arrangement order of the first display electrodes is odd or even, in the first display electrodes;

dividing the plural second display electrodes into groups of two rows for each group with the electrodes of each groups connected in common electrically;

dividing an address period into a first half and a second half when performing addressing by controlling a potential of each of the address electrodes in accordance with display data in parallel with row selection for biasing a second display electrode of the electrode pair corresponding to a selected row to a selecting potential temporarily;

performing row selection in the first half in which the first display electrodes of the first group are biased as a whole and all scan electrodes are biased one by one;

performing row selection in the second half in which the common electrodes of the second group are biased as a whole and all scan electrodes are biased one by one;

making a cell-selecting voltage applied to interelectrode AY between the second display electrode and the address electrode for the row selection lower than a discharge starting voltage of the interelectrode AY; and applying a row selection voltage that is lower than a discharge starting voltage of interelectrode XY between the display electrodes of the electrode pair corresponding to the selected row to the interelectrode XY so as to generate an address discharge.

11. A method for driving a plasma display panel in which a plurality of display electrodes is arranged as plural pairs of electrodes corresponding to plural respective rows, and each electrode pair provides for a surface discharge in the respective row thereof and is arranged so that one electrode is shared by two neighboring rows for display, and a plurality of address electrodes is arranged so as to cross the electrode pair in each column, and a partition having a grid shape in a plan view for dividing the discharge space for each cell is provided, the method comprising:

performing addressing of erasing format by reducing wall charge of the cell to be off display after a process of forming wall charge in all cells;

classifying the plural display electrodes into two groups in accordance with whether an arrangement order of the display electrode is odd or even;

making the display electrodes belonging to one group to be scan electrodes that can be controlled independently;

making the display electrodes belonging to the other group to be common electrodes that do not need independent control;

classifying the common electrodes into a first group and a second group in accordance with whether an arrangement order counted by noting only the common electrodes is odd or even;

dividing an address period for performing the addressing into a first half and a second half;

performing row selection in the first half in which the common electrodes of the first group are biased as a whole and all scan electrodes are biased one by one after inverting a polarity of wall charge of a row selected in the second half; and performing row selection in the second half in which the common electrodes of the second group are biased as a whole and all scan electrodes are biased one by one after inverting a polarity of wall charge of a row selected in the first half.

* * * * *

UNITED STATES PATENT AND TRADEMARK OFFICE

CERTIFICATE OF CORRECTION

PATENT NO. : 6,900,797 B2
DATED : May 31, 2005
INVENTOR(S) : Hitoshi Hirakawa et al.

It is certified that error appears in the above-identified patent and that said Letters Patent is hereby corrected as shown below:

Column 14,
Line 66, after "even" delete ",".

Column 15,
Line 14, replace "halt." with -- half. --.
Line 44, after "even" delete ",".

Column 16,
Line 16, after "even" delete ",".

Signed and Sealed this

Twenty-first Day of March, 2006

JON W. DUDAS
*Director of the United States Patent and Trademark Office*